US006239537B1

(12) United States Patent
Enomoto et al.

(10) Patent No.: US 6,239,537 B1
(45) Date of Patent: May 29, 2001

(54) CATHODE RAY TUBE INCLUDING A PLURALITY OF NECKS

(75) Inventors: Takashi Enomoto; Takashi Nishimura, both of Fukaya; Noboru Inoue, Shizuoka-ken; Susumu Hoshika, Shimada; Haruyuki Kimura, Fujieda, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/280,654

(22) Filed: Mar. 29, 1999

(30) Foreign Application Priority Data

Mar. 31, 1998 (JP) ..... 10-087078

(51) Int. Cl.[7] ..... H01J 31/00

(52) U.S. Cl. ..... 313/2.1; 313/402; 313/407; 313/422; 313/477 R; 313/482

(58) Field of Search ..... 313/2.1, 407, 422, 313/402, 477 R, 482

(56) References Cited

U.S. PATENT DOCUMENTS 5,365,142 * 11/1994 Nishimura et al. ..... 313/2.1
5,506,470 * 4/1996 Inoue et al. ..... 313/477 R

* cited by examiner

*Primary Examiner*—Vip Patel
*Assistant Examiner*—Kevin Quarterman
(74) *Attorney, Agent, or Firm*—Pillsbury Winthrop LLP

(57) ABSTRACT

A vacuum envelope of a cathode ray tube comprises a faceplate and a rear envelope bonded to the faceplate. The rear envelope includes a rear plate opposed to the faceplate, a side wall, a plurality of funnels extending from the rear plate, partition walls set up on the rear plate, and necks bonded individually to the funnels. The rear envelope is formed by connecting a plurality of miniature envelopes to one another. Each miniature envelope includes at least one funnel, and is molded by pressing.

8 Claims, 20 Drawing Sheets

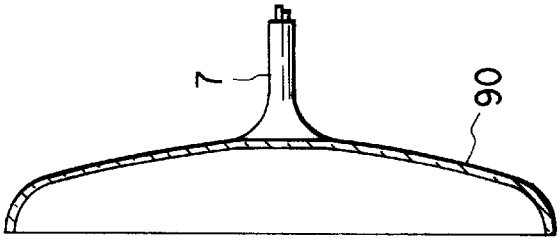
FIG. 31C
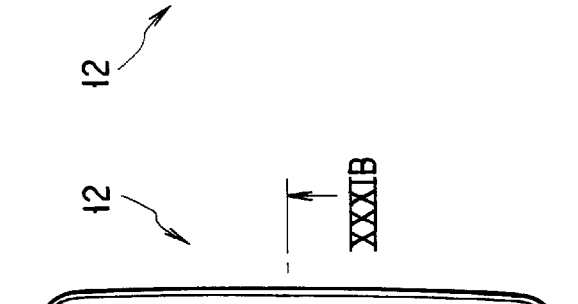
FIG. 31B
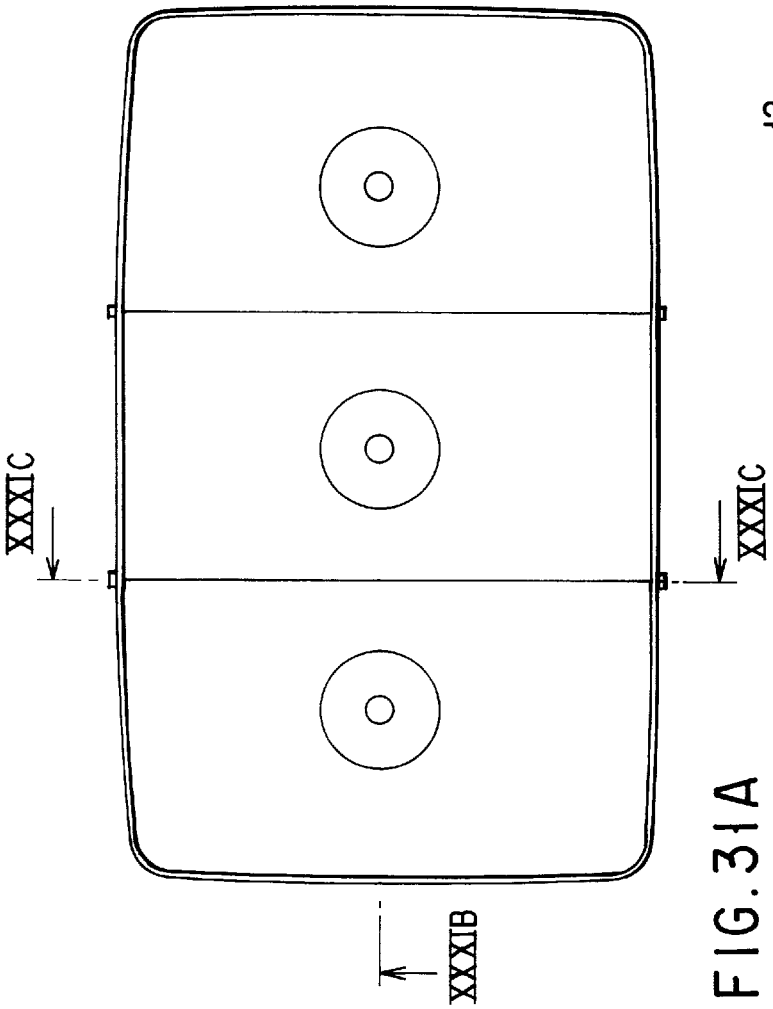
FIG. 31A
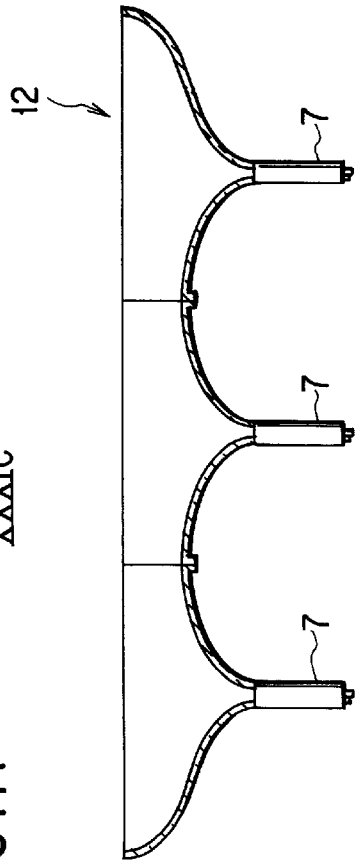

CATHODE RAY TUBE INCLUDING A PLURALITY OF NECKS

BACKGROUND OF THE INVENTION

The present invention relates to a cathode ray tube, and more particularly, to a cathode ray tube, in which a plurality of regions of a single phosphor screen are dividedly scanned by electron beams emitted from a plurality of electron guns, and a method of manufacturing the same.

These days there is an increasing demand for high-resolution cathode ray tubes having a large screen for high-definition broadcasting, and their screen requires much higher display performance. To meet this demand or requirement, it is essential to make the screen surface flatter and further improve the resolution. At the same time, the screen must be reduced in weight and thickness.

The above demand is met by a cathode ray tube that is described in Jpn. Pat. Appln. KOKAI Publication No. 5-36363. In this device, a plurality of regions of an integral phosphor screen formed on the inner surface of a flat faceplate is dividedly scanned with electron beams that are emitted from electron guns and deflected by means of deflectors.

In this cathode ray tube, a vacuum envelope is formed in a manner such that the flat faceplate and a flat rear plate are opposed to each other with a side wall between them, and a plurality of funnels are bonded to areas around apertures in the rear plate. The integral phosphor screen is formed on the inner surface of the faceplate. A deflector is attached to the outside of each funnel, while an electron gun is arranged in the neck of each funnel.

In the cathode ray tube constructed in this manner, the electron beams emitted from the individual electron guns are deflected by means of magnetic fields that are generated by their corresponding deflectors. The phosphor screen has a plurality of regions, e.g., 20 regions, five in each row in the horizontal direction and four in each column in the vertical direction, and these regions are dividedly scanned with the deflected electron beams. A plurality of divided images formed on the phosphor screen by this divided scanning are connected by means of signals applied to the electron guns and the deflectors, whereupon one large image is formed without any gaps or overlapping on the whole surface of the phosphor screen.

According to the system described above, the cathode ray tube can be reduced in weight and thickness, and its screen surface can be flattened. The reduction in thickness results in a shorter distance between each electron gun and the phosphor screen and facilitates use of an electron lens of lower power. Thus, the diameters of electron beam spots on the phosphor screen are reduced, so that the resolution can be improved.

In the cathode ray tube of this type, moreover, a plurality of columnar support members are arranged between the faceplate and the rear plate, whereby an atmospheric pressure load that acts on the vacuum envelope can be supported. The proximal end of each support member is fixed to the rear plate, while the distal end, wedge-shaped, is in engagement with a black light-absorbing layer of the phosphor screen. When an image is displayed, therefore, the support members can never be seen frontally.

In the cathode ray tube having the aforementioned construction, however, the rear plate, the funnels, and a side plate that constitute a rear envelope cannot be easily positioned with satisfactory accuracy as they are fixed to one another by means of a bonding agent, so that dislocation easily occurs. Accurate relative positioning of the rear plate, funnels, and side wall requires complicated assembling processes, thus entailing an increase in manufacturing cost. Further, joint portions between the individual members lower the reliability of withstand voltage characteristics, vacuum characteristics, etc.

As a measure to solve these problems, a method may possibly be used in which the rear plate, funnels, and side wall are molded integrally from one glass sheet. In this case, the glass sheet as a material is first softened by being heated to a temperature higher than its softening point. Then, the softened glass sheet is held against a carbon mold with a given shape, and is shaped along the mold. Each funnel, made of glass, is reduced in wall thickness on its neck side. A preformed flaring neck is welded to the neck-side end portion of each funnel by burner heating, whereupon the rear envelope is completed.

In the case where the rear envelope is integrally molded in the aforesaid manner, however, glass remains in excess in the corner portions at which the side wall is bent, so that the surplus glass should be driven away to the periphery and cut. This molding operation is very difficult. In addition, the residual glass easily renders the glass thickness distribution uneven, and annealing the glass takes much time.

In the case where the rear envelope is integrally molded, moreover, mold release is difficult due to the difference in thermal expansion coefficient between the glass and the carbon mold. The higher the side wall and the funnels, the more critical this problem will be. Since the rear envelope is integrally molded, it should be regarded as entirely defective if only one of the funnels is cracked or chipped. In welding the necks, furthermore, the whole rear envelope is regarded also as defective if only one of the necks is subject to poor weld. In consequence, the efficiency of manufacture lowers.

Selecting the glass sheet as a material is a problem common to both the integral rear envelope and the rear envelope that is formed by fixing the rear plate, funnels, and side wall by means of a bonding agent. In the cathode ray tube in which the phosphor screen is made to glow with electron beams, as mentioned before, the characteristics of the vacuum envelope, such as volume resistivity, coloring by electron rays, X-ray leakage, etc., should meet their standard requirements. However, there are no existing glass sheets of which all the characteristics meet the requirements.

It is necessary, therefore, to use a surface-treated existing glass sheet or manufacture a novel glass sheet material. However, conventional methods of surface treatment, such as the ion-exchange reinforcement, surface coating, etc., are not effective for the purpose. On the other hand, the manufacture of a novel glass sheet material costs too high to be feasible.

BRIEF SUMMARY OF THE INVENTION

The present invention has been contrived in consideration of these circumstances, and its object is to provide a cathode ray tube and a method of manufacturing the same, whereby the reliability of the withstand voltage characteristics, vacuum characteristics, etc. of a vacuum envelope can be satisfactorily maintained, other characteristics of the envelope, such as volume resistivity, coloring by electron rays, X-ray leakage, etc., can be fulfilled, and molding can be easily carried out without increasing the manufacturing cost.

In order to achieve the above object, a cathode ray tube according to the present invention comprises a substantially rectangular faceplate, a substantially rectangular rear envelope including a plurality of funnels and opposed to the faceplate, a plurality of necks connected to the funnels, individually, and a plurality of support members located between the faceplate and the rear envelope and supporting the atmospheric pressure acting on the faceplate and the rear envelope, the rear envelope being formed by connecting a plurality of miniature envelopes each including a funnel corresponding to at least one of the necks.

Further, a cathode ray tube according to the invention comprises a substantially rectangular panel, a rear envelope opposed to the panel, and a plurality of necks connected to the rear envelope, the rear envelope being formed by connecting a plurality of miniature envelopes molded so as to be connected with at least one of the necks each.

According to the invention, moreover, there is provided a method of manufacturing a cathode ray tube, which includes a substantially rectangular flat faceplate, a substantially rectangular rear envelope including a plurality of funnels and opposed to the faceplate, a plurality of necks connected to the funnels, individually, and a plurality of support members located between the faceplate and the rear envelope and supporting the atmospheric pressure acting on the faceplate and the rear envelope, the method comprising a process for forming the rear envelope by connecting a plurality of miniature envelopes each including a funnel corresponding to at least one of the necks.

According to the invention, furthermore, there is provided a manufacturing method for a cathode ray tube, which includes a substantially rectangular panel, a rear envelope opposed to the panel, and a plurality of necks connected to the rear envelope, the method comprising: forming the rear envelope by connecting a plurality of miniature envelopes molded so as to include at least one of the necks each.

According to the cathode ray tube constructed in this manner and the manufacturing method therefor, the miniature envelopes can be molded by directly utilizing the pressing technique that is used in molding bulbs for existing cathode ray tubes. Accordingly, all the problems proper to glass sheet forming can be solved, so that quality maintenance for forming is easy. Further, existing manufacturing equipment can be diverted to the purpose. Thus, there is no need of investment in new equipment that entails an increase in manufacturing cost.

If there is any failure in neck welding or the like, moreover, a single miniature envelope or envelopes must only be replaced, so that the manufacturing efficiency can be improved. In the case where the pressing technique is used for the molding operation, furthermore, the cost at which the miniature envelopes are press-molded from a novel material can be made much lower than the cost at which a glass sheet is molded from the novel material. Thus, the miniature envelopes can be molded with use of a material for bulbs for existing cathode ray tubes, and the problems on the volume resistivity, coloring by electron rays, x-ray leakage, and other characteristics can be solved.

Since the rear envelope is constructed by connecting the miniature envelopes, various cathode ray tubes with different sizes can be formed with ease by changing the number and combination of miniature envelopes. Thus, larger screens can be easily formed without requiring new molds for the manufacture the different-size cathode ray tubes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 31A is a plan view showing a rear envelope of the cathode ray tube according to the fifth embodiment;

FIG. 31B is a sectional view taken along line XXXIB—XXXIB of FIG. 31A;

FIG. 31C is a sectional view taken along line XXXIC—XXXIC of FIG. 31A.

DETAILED DESCRIPTION OF THE INVENTION

Cathode ray tubes according to preferred embodiments of the present invention will now be described in detail with reference to the accompanying drawings.

Figure 1:
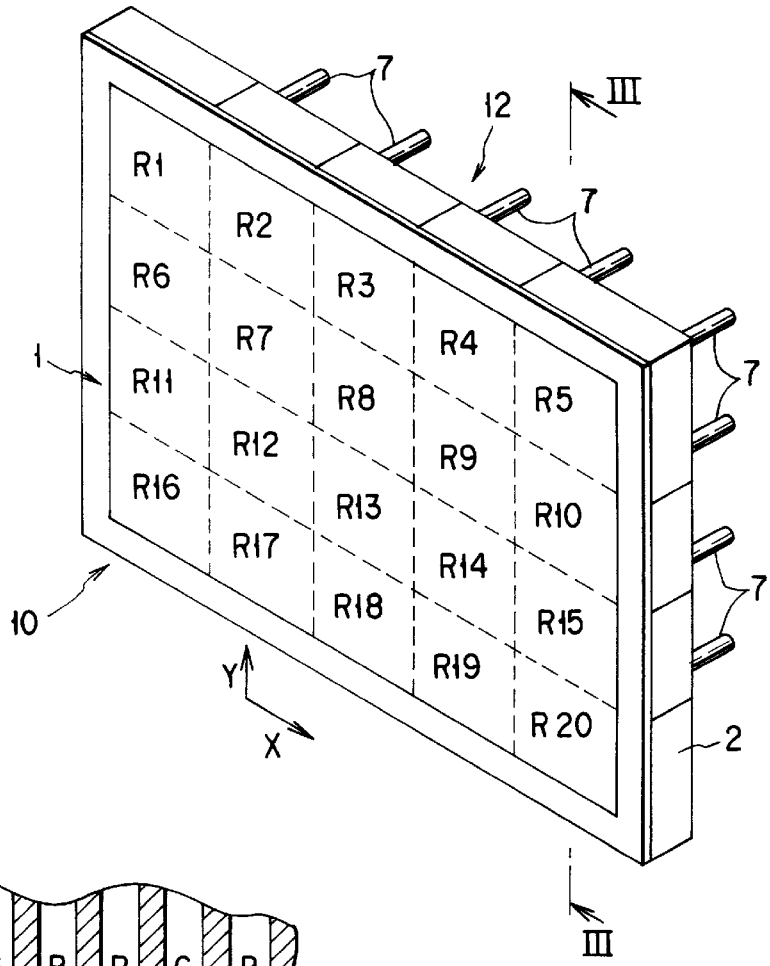
FIG. 1 is a perspective view showing a cathode ray tube according to a first embodiment of the present invention.
Figure 3:
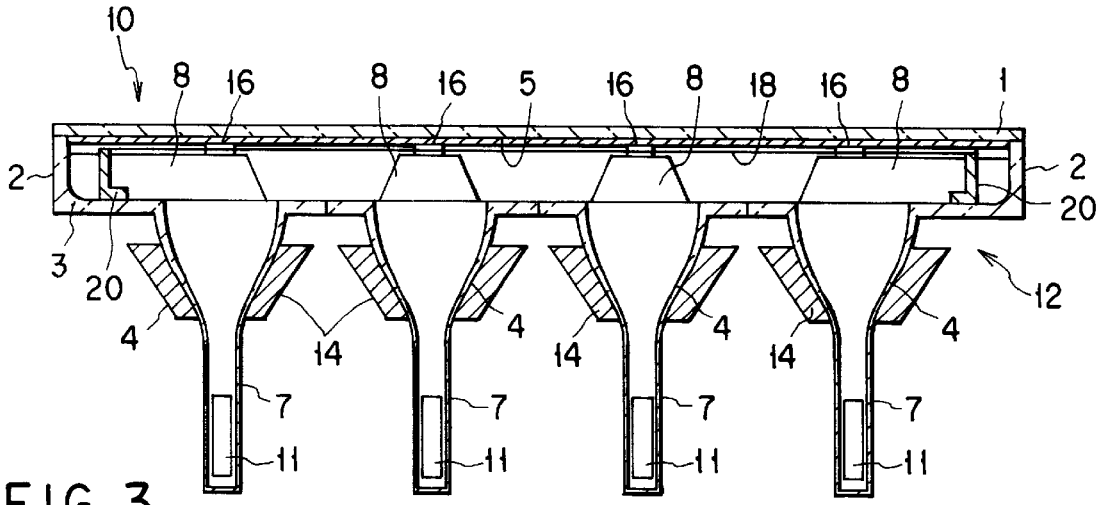
FIG. 3 is a sectional view taken along line III—III of FIG. 1.

As shown in FIGS. 1 and 3, a cathode ray tube comprises a vacuum envelope 10, which includes a substantially rectangular flat faceplate 1 of glass and a substantially rectangular rear envelope 12 of glass having a plurality of funnels 4. The rear envelope 12 is bonded to the peripheral edge portion of the faceplate 1 by means of a bonding material such as frit glass.

Figure 2:
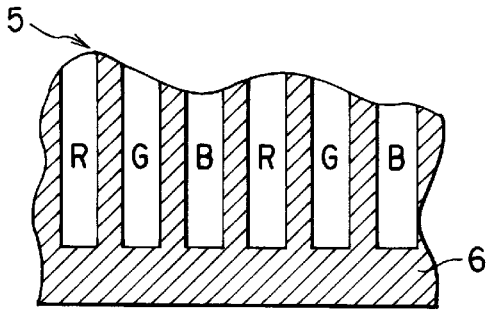
FIG. 2 is a plan view schematically showing a phosphor screen of the cathode ray tube.

Formed on the inner surface of the faceplate 1 is a phosphor screen 5, which has a rectangular integral structure as a whole. As shown in FIG. 2, the screen 5 includes black light-absorbing layers 6 and three color phosphor layers R, G, B. The light-absorbing layers 6 are in the form of stripes that are arranged in parallel to one another at given intervals in a horizontal direction X. The phosphor layers are in the form of stripes that are arranged between the light absorbing layers, extending in a vertical direction Y, and glow in three colors, red (R), green (G), and blue (B), individually.

Figure 4:
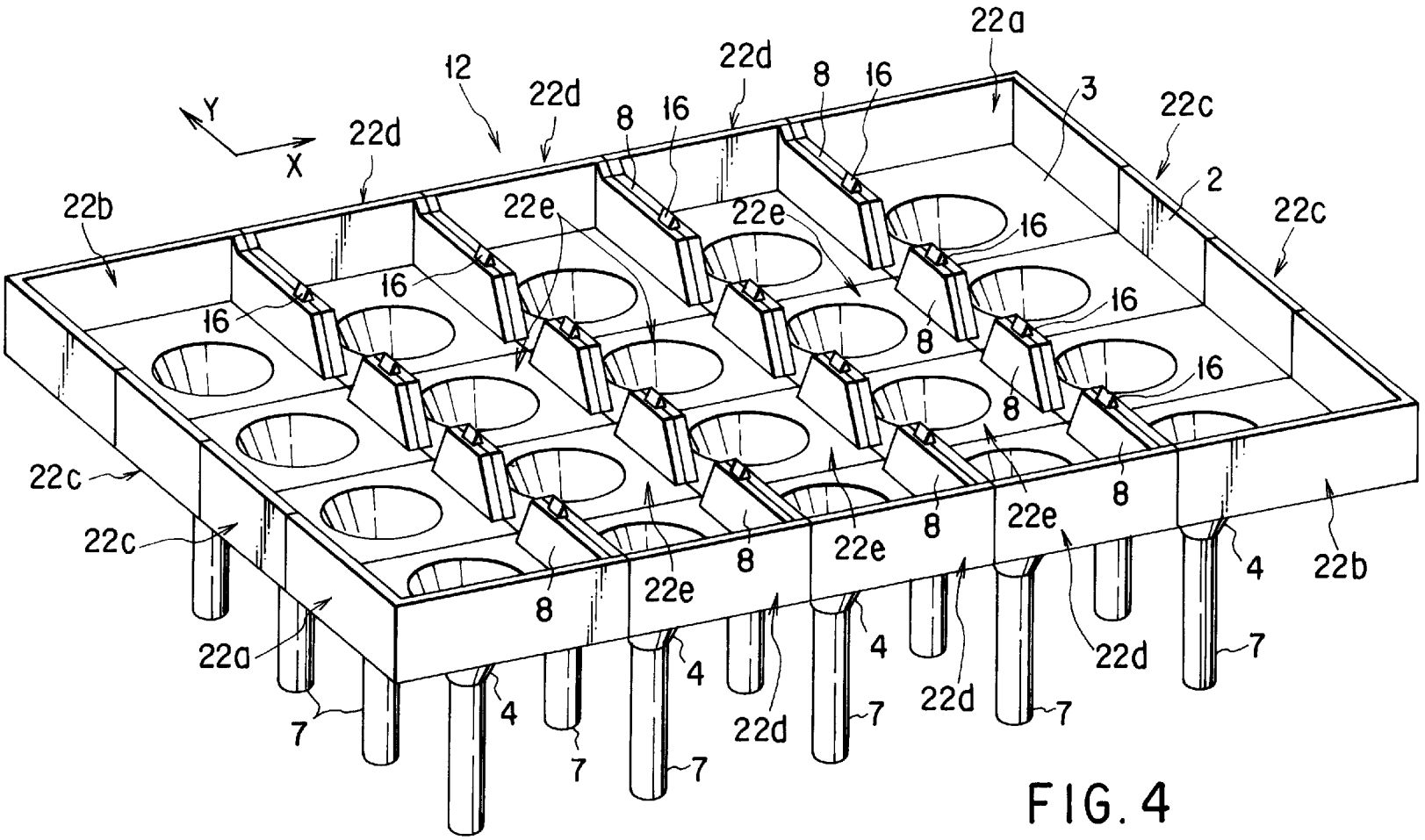
FIG. 4 is a perspective view showing a rear envelope of the cathode ray tube.
Figure 5A:
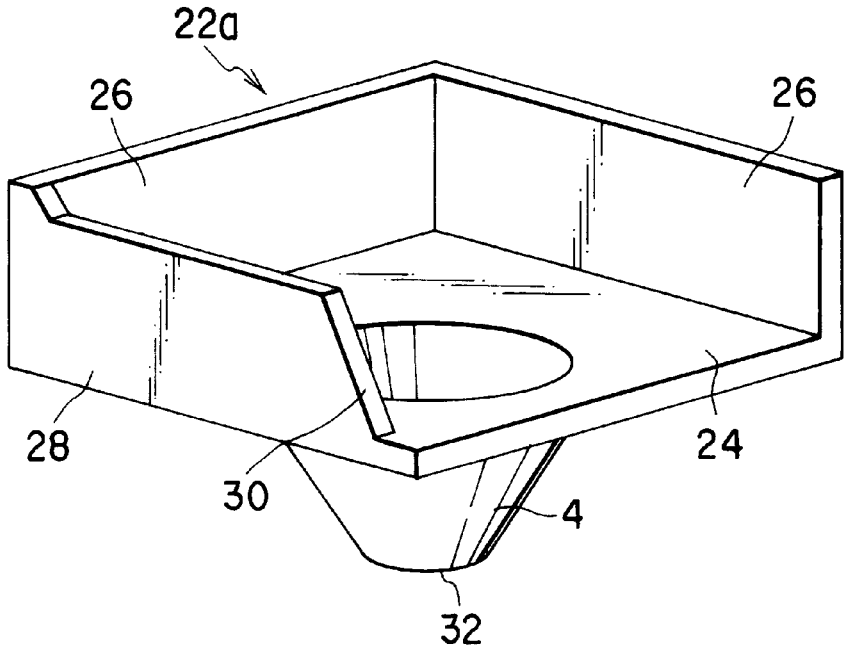
FIGS. 5A and 5B are perspective views individually showing two miniature envelopes constituting the rear envelope.
Figure 5B:
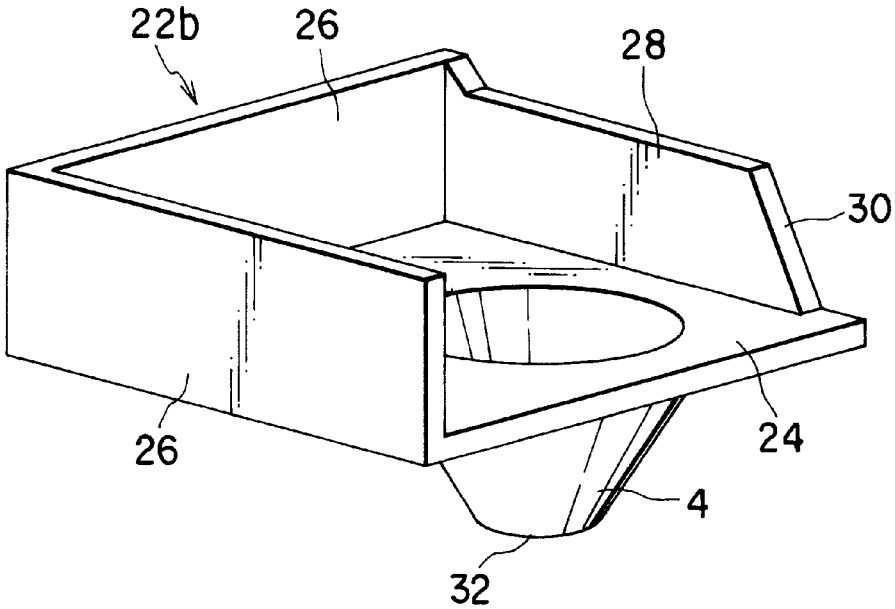
Figure 6A:
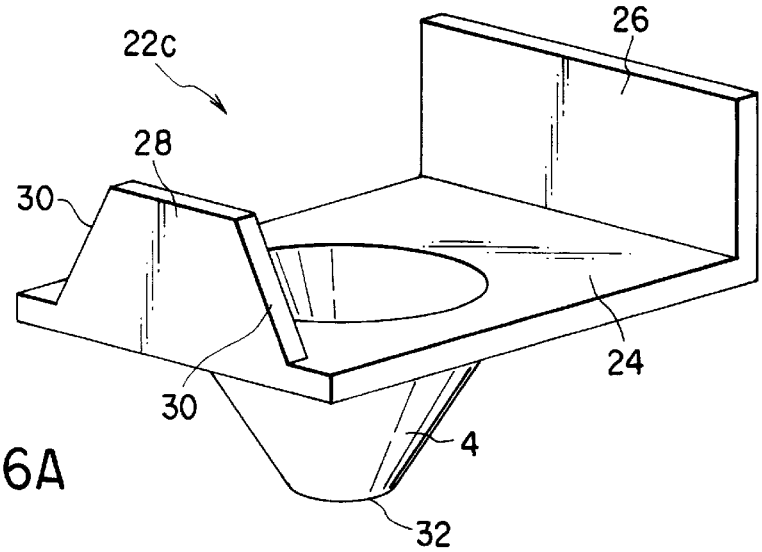
FIGS. 6A and 6B are perspective views individually showing two other miniature envelopes constituting the rear envelope.
Figure 6B:
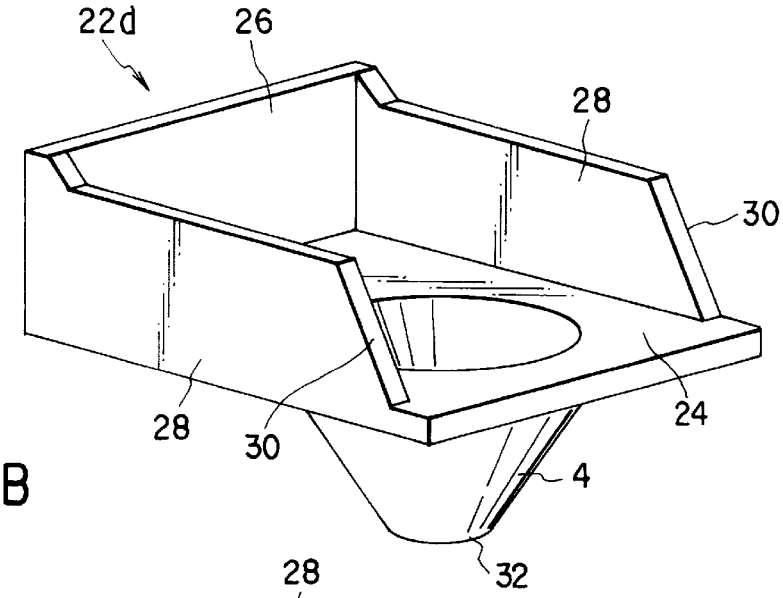
Figure 7:
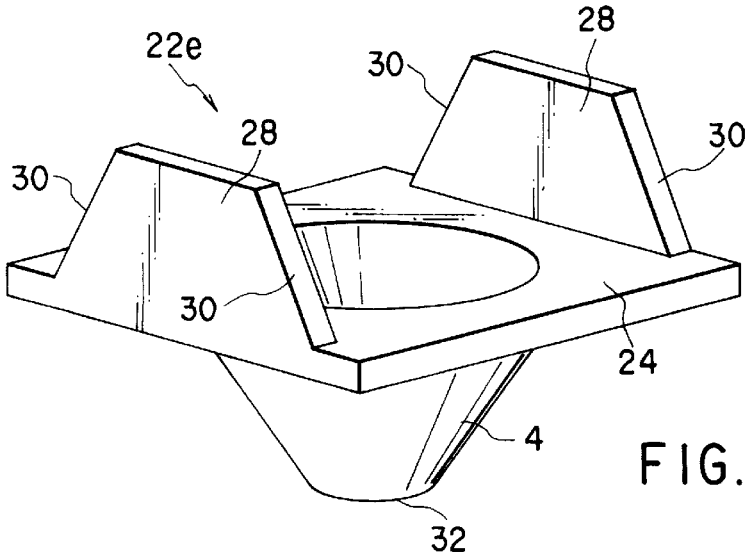
FIG. 7 is a perspective view showing another miniature envelope constituting the central portion of the rear envelope.

As shown in FIGS. 1, 3 and 4, the rear envelope 12 of the vacuum envelope 10 integrally comprises a substantially rectangular flat rear plate 3, a plurality of funnels 4 extending from the rear plate, and a side wall 2 in the form of a rectangular frame that is set up substantially perpendicular to the peripheral edge portion of the rear plate. In the present embodiment, the funnels 4 are arranged in the form of a matrix and are 20 in total number, five in each row in the horizontal direction (X-direction) and four in each column in the vertical direction (Y-direction), for example. The rear envelope 12 forms the vacuum envelope 10 in a manner such that the extending end edge of its side wall 2 is bonded to the faceplate 1.

In the rear envelope 12, moreover, a number of partition walls 8 are set up on the inner surface of the rear plate 3 and extend in the vertical direction Y. Each partition wall 8 is located between each two funnels 4 that adjoin in the horizontal direction X. The height of each partition wall 8 is adjusted to about 70 to 95% of that of the side wall 2.

A support member 16 for supporting an atmospheric pressure load is located on the upper end of each partition wall 8. The member 16 is a wedge-shaped structure of a nickel alloy having a thermal expansion coefficient substantially equal to that of glass, and its height is adjusted to 5 to 30% of that of the side wall 2. The underside of each support member 16 is bonded integrally to the top surface of each corresponding partition wall 8 by means of fritted glass. Each support member 16 is situated so that the extending direction of its distal end edge is in line with the vertical direction Y, and is in contact with one of the black light-absorbing layers 6 of the phosphor screen 5. In particular, each support member 16 is located so that its distal end engages the boundary between each two adjacent divided regions (mentioned later) of the phosphor screen 5. Thus, the support members 16, along with the partition walls 8, support the atmospheric pressure acting on the faceplate 1 and the rear plate 3.

A neck 7 is bonded to the extending end of each funnel 4, and an electron gun 11 for emitting electron beams toward the phosphor screen 5 is sealed in the neck. Further, a deflector 14 is mounted on the outer periphery of each funnel 4.

In the vacuum envelope 10, as shown in FIG. 3, a shadow mask 18 having a number of electron beam passage apertures is opposed to the phosphor screen 5. The mask 18 is composed of five equal division masks that are arranged in the horizontal direction, corresponding individually to a plurality of divided regions (mentioned later) of the phosphor screen 5. The opposite end portions of each division mask are attached to mask holding members 20 that are fixed individually to the vertically opposite end portions of the inner surface of the rear envelope 12 that faces the faceplate 1. Thus, each division mask is located in the vacuum envelope 10 in a manner such that it is subjected to a tension in the vertical direction Y.

In the cathode ray tube constructed in this manner, the electron beams emitted from the individual electron guns 11 are deflected by means of magnetic fields that are generated by their corresponding deflectors 14. With this operation, a plurality of regions of the phosphor screen 5, that is, 20 regions R1 to R20, five in each row in the horizontal direction X and four in each column in the vertical direction Y, are dividedly scanned by the electron beams through the shadow mask 18. Images formed on the 20 regions of the screen 5 by this divided scanning are connected by signals applied to the electron guns 11 and the deflectors 14, whereupon one large image is reproduced without any gaps or overlapping on the whole surface of the phosphor screen 5.

The following is a detailed description of the construction of the rear envelope 12 of the vacuum envelope 10. According to the present embodiment, the rear envelope 12 is formed by connecting a plurality of types of miniature envelopes and bonding a neck tube to each funnel. Thus, the rear envelope 12 is obtained by connecting two pairs of miniature envelopes 22*a* and 22*b* of two different types, which form the corner portions of the envelope 12, four miniature envelopes 22*c*, two on each side, which form the opposite end portions of the envelope 12 in the horizontal direction X, six miniature envelopes 22*d*, three on each vertical end, which form the opposite end portions of the envelope 12 in the vertical direction Y, and six miniature envelopes 22*e*, which form the central portion of the envelope 12, as shown in FIGS. 4 to 7.

Each miniature envelope 22*a* (first miniature envelope) integrally includes a rectangular bottom wall 24 that constitutes the rear plate 3 of the rear envelope 12, a pair of side walls 26 that are set up on two orthogonal sides of the bottom wall and constitute the side wall 2 of the envelope 12, and an inner wall 28 that is set up on another side of the bottom wall 24 and constitutes one of the partition walls 8. A funnel 4 is formed extending integrally downward from the central portion of the bottom wall 24. The height of the inner wall 28 is adjusted to 70 to 95% of that of each side wall 26. The extending end of the inner wall 28, which is remoter from the adjacent side wall 26, is formed having a notch 30 such that the vacuum envelope 10 can be evacuated efficiently.

Each miniature envelope 22*b* (second miniature envelope), like each miniature envelope 22*a*, integrally includes a rectangular bottom wall 24, a pair of side walls 26, and an inner wall 28. The second miniature envelope 22*b* is constructed in the same manner as the first one except that the inner wall 28 and the side walls 26 are located contrariwise.

Each miniature envelope 22*c* (third miniature envelope) integrally includes a rectangular bottom wall 24 that constitutes the rear plate 3 of the rear envelope 12, a side wall 26 that is set up on one side of the bottom wall and constitutes the side wall 2 of the envelope 12, and a inner wall 28 that is set up on another side of the bottom wall 24 so as to face the side wall 26 in parallel relation and constitutes one of the partition walls 8. One of the funnels 4 is formed extending integrally downward from the central portion of the bottom wall 24. The height of the inner wall 28 is adjusted to 70 to 95% of that of the side wall 26. Each end portion of the inner wall 28 is formed having a notch 30.

Each miniature envelope 22*d* (fourth miniature envelope) integrally includes a rectangular bottom wall 24 that constitutes the rear plate 3 of the rear envelope 12, a side wall 26 that is set up on one side of the bottom wall and constitutes the side wall 2 of the envelope 12, and a pair of inner walls 28 that are set up individually on those two sides of the bottom wall 24 which extend at right angles to the side wall 26 and individually constitute two of the partition walls 8. One of the funnels 4 is formed extending integrally downward from the central portion of the bottom wall 24. The height of each inner wall 28 is adjusted to 70 to 95% of that of the side wall 26. That end portion of each inner wall 28 which is remoter from the side wall 26 is formed having a notch 30.

Further, each miniature envelope 22*e* (fifth miniature envelope) integrally includes a rectangular bottom wall 24 that constitutes the rear plate 3 of the rear envelope 12, a pair of inner walls 28 that are set up individually on two opposite sides of the bottom wall and individually constitute two of the partition walls 8, and one of the funnels 4 extending downward from the central portion of the bottom wall 24. The height of each inner wall 28 is adjusted to 70 to 95% of that of each of the aforesaid side walls 26. Each end portion of each inner wall 28 is formed having a notch 30.

Figure 8:
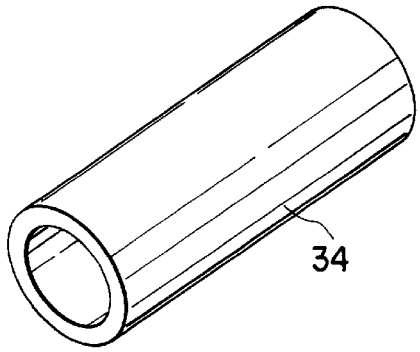
FIG. 8 is a perspective view of a neck tube constituting the rear envelope.
Figure 9A:
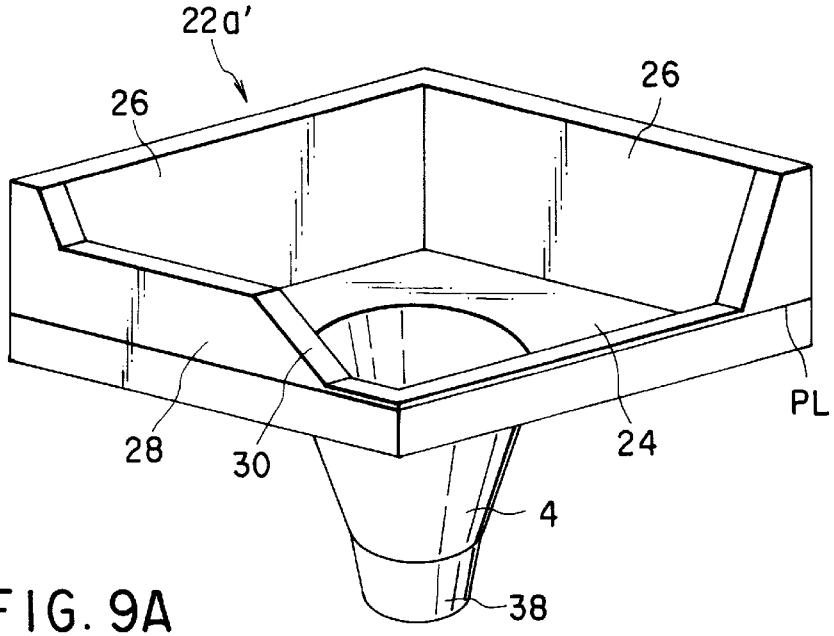
FIGS. 9A and 9B are perspective views individually showing two press-molded miniature envelope elements.
Figure 9B:
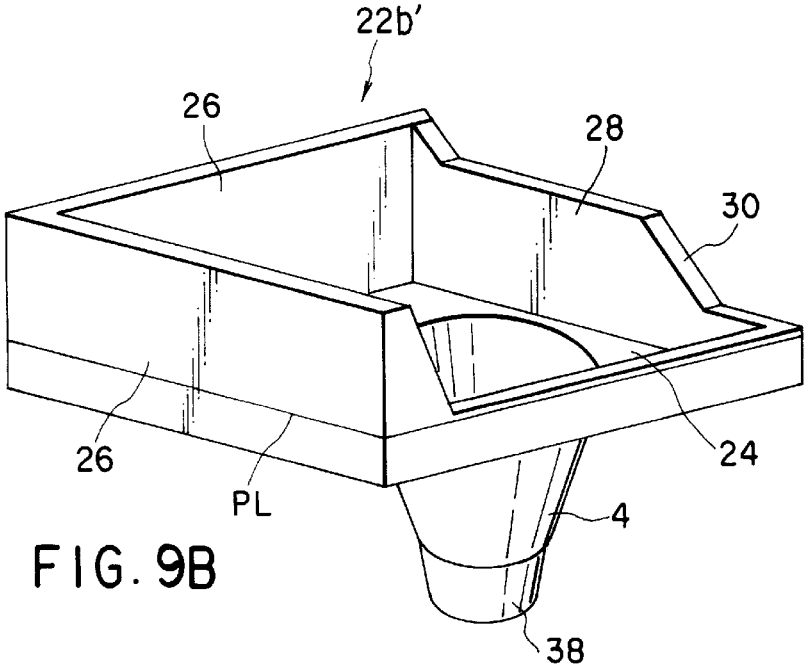
Figure 10A:
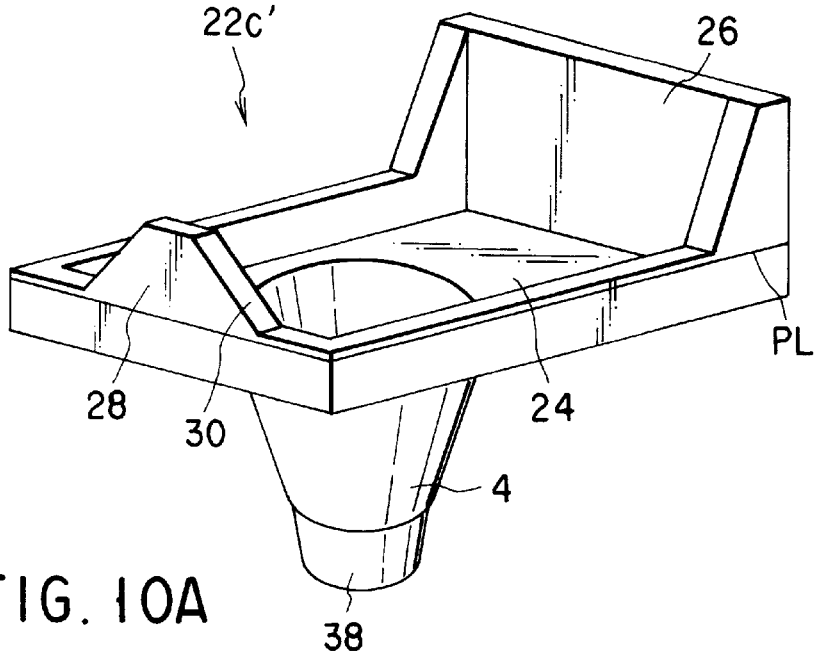
FIGS. 10A and 10B are perspective views individually showing two other press-molded miniature envelope elements.
Figure 10B:
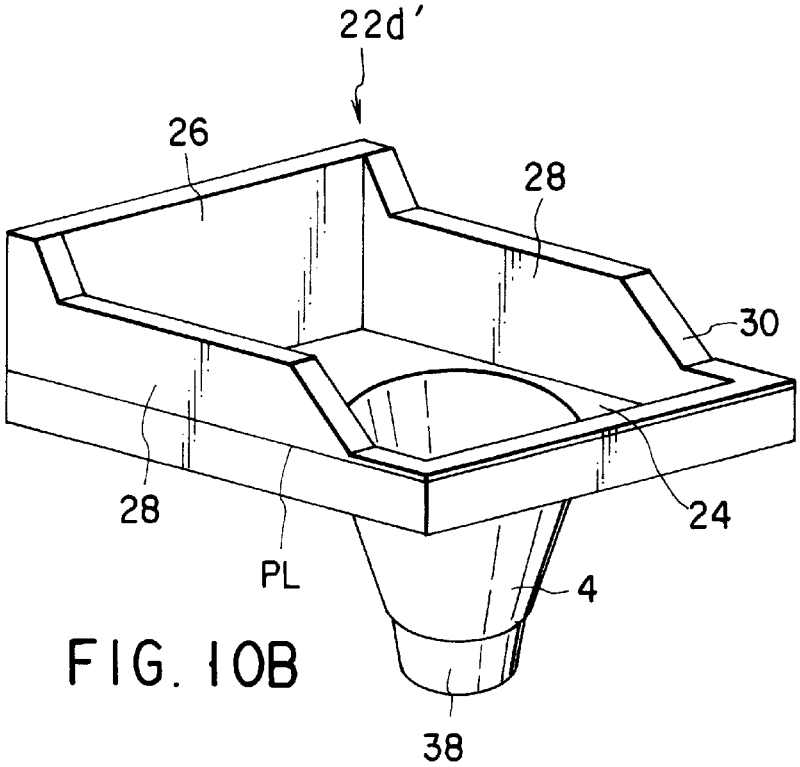
Figure 11:
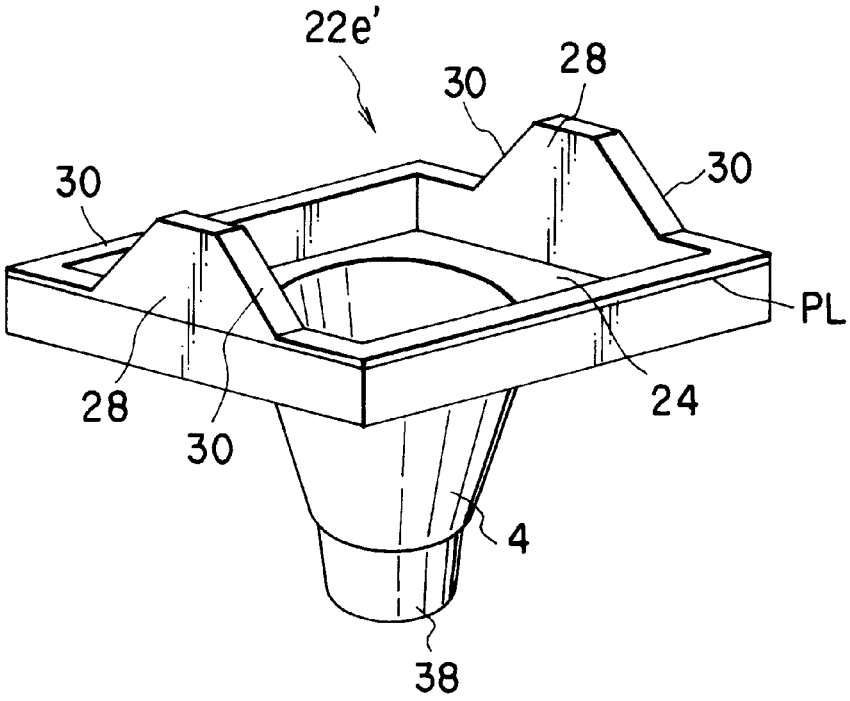
FIG. 11 is a perspective view showing another press-molded miniature envelope element.

As shown in FIG. 8, one end of a neck tube 34 that constitutes one of the necks 7 is bonded to an end portion 32 of the funnel 4 of each of the miniature envelopes 22*a* to 22*e*. These miniature envelopes 22*a* to 22*e* are connected to one another to form the rear envelope 12. Thus, the rear envelope 12 is composed of 20 miniature envelopes, five in each row in the horizontal direction and four in each column in the vertical direction.

The following is a description of a method of manufacturing the cathode ray tube constructed in this manner.

First, the miniature envelopes 22*a* to 22*e*, which constitute the rear envelope 12, are formed as miniature envelope elements 22*a'* to 22*e'* shown in FIGS. 9A to 11, respectively. These envelope elements are obtained by press-molding a glass material by means of dies in the same manner as those of conventional cathode ray tubes.

Figure 12:
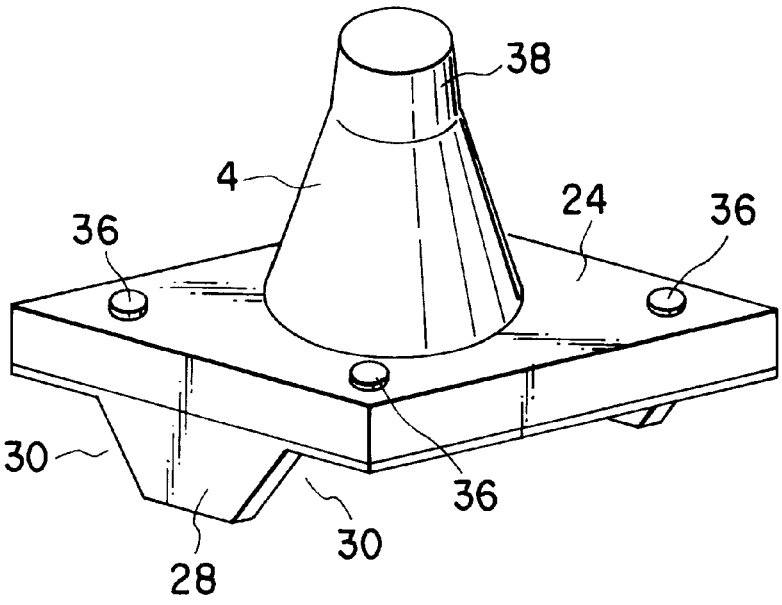
FIG. 12 is a perspective view showing the underside of the miniature envelope element of FIG. 11.

In each of the miniature envelope elements 22*a'* to 22*e'*, cylindrical reference seats 36 are formed individually on the corner portions of the underside of the bottom wall 24, as shown in FIG. 12. The reference seats 36 serve as references for working processes for the miniature envelope elements, including cutting a residual pool (mentioned later) at the end portion of the funnel 4, polishing surfaces to be coupled in a matrix, and connecting the neck tube 34. It is to be understood that each edge or angle portion should be given a radius or release gradient (not shown) for press molding.

According to this molding method, the miniature envelope elements 22*a'* to 22*e'* are press-molded from a glass gob (high-temperature mass of glass) by means of a pressing machine 51 shown in FIGS. 13 to 15B. The pressing machine 51 is provided with a rotating table 52 and a pressing mechanism 55 overlying the table. The table 52 is intermittently rotated by means of a drive mechanism 53. A plurality of molds 40 are arranged at given intervals in the circumferential direction over the table 52.

Figure 15A:
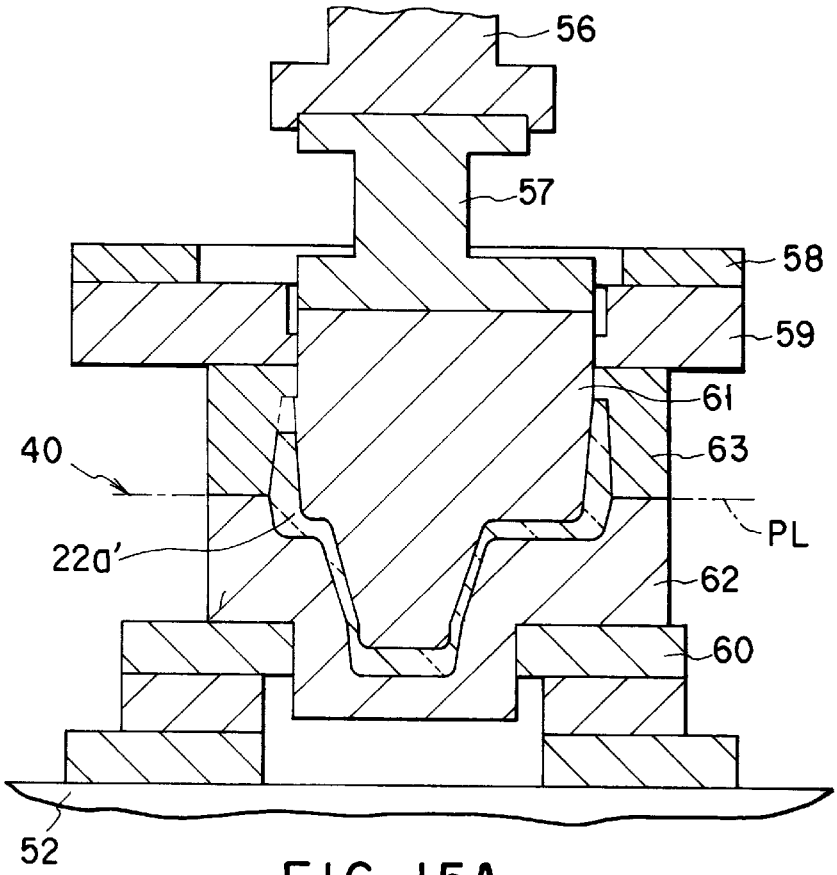
FIGS. 15A and 15B are sectional views individually showing processes for press-molding the miniature envelopes by means of a mold of the pressing machine.
Figure 15B:
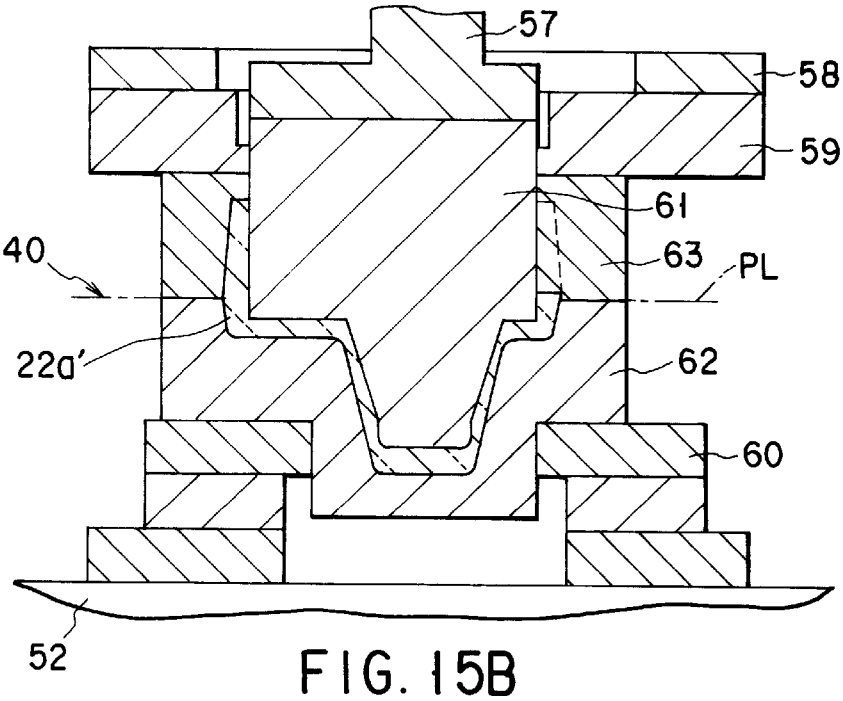
Figure 16:
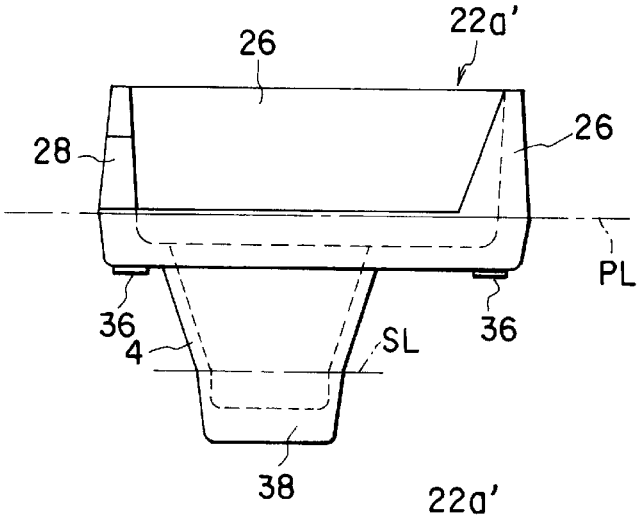
FIG. 16 is a side view of a miniature envelope element molded by means of the pressing machine.

As shown in FIGS. 15A and 15B, each mold 40 includes a bottom 62, which is set over the rotating table 52 by means of a bottom anvil 60, and a shell ring 63 removably mounted on the bottom 62. A plunger 61 can be inserted into the respective cavities of the bottom and the shell ring.

As shown in FIGS. 13 to 15B, the pressing mechanism 55 is provided with a press cylinder 54 that extends in the vertical direction. A machine adapter 56 is fixed to the lower end of a piston of the cylinder 54, and the plunger 61 can be connected to the adapter by means of a holder 57. Further, the piston of the press cylinder 54 is fitted is a spring plate 58, which holds down the shell ring 63 of the mold 40 with the aid of a ring plate 59.

Figure 13:
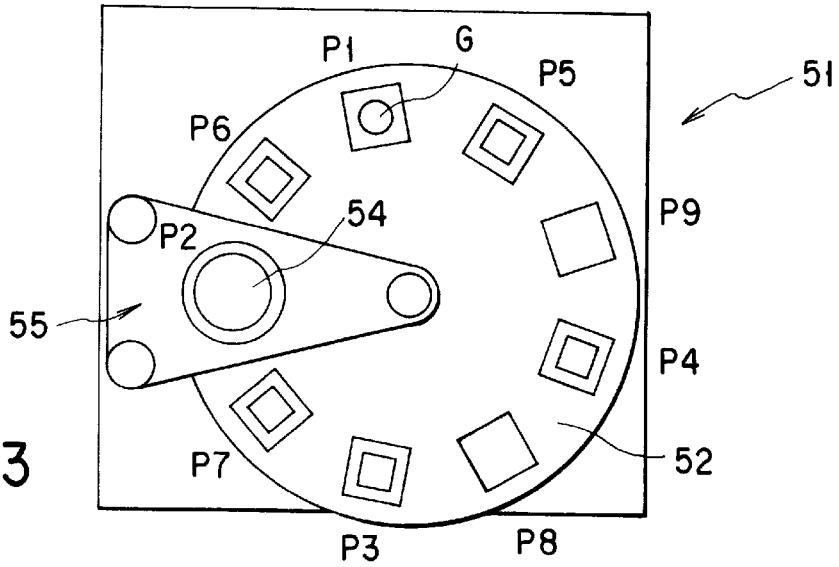
FIG. 13 is a plan view showing a pressing machine used to mold the miniature envelopes.
Figure 14:
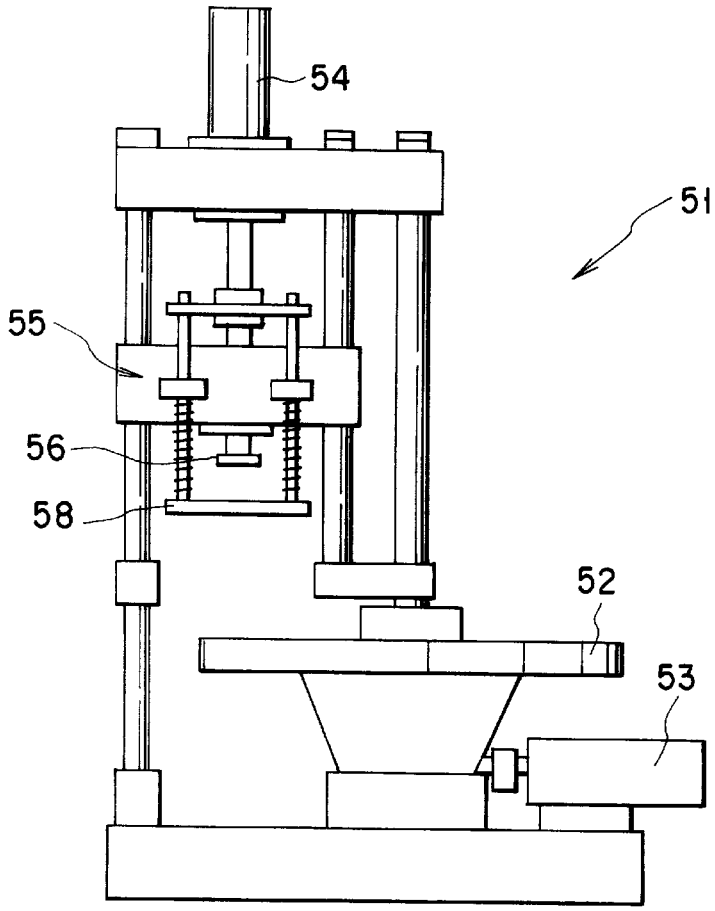
FIG. 14 is a side view of the pressing machine.

As shown in FIG. 13, the pressing machine 51 molds a miniature envelope in forming processes in nine positions P1 to P9, for example. Thus, the glass gob is supplied to the mold 40 in the position P1. As the rotating table 52 rotates intermittently, thereafter, the mold 40 moves from the position P1 to the position P9.

Press molding is carried out in the position P2. More specifically, the press cylinder 54 of the pressing mechanism 55 is actuated so that the shell ring 63 of the mold 40 is pressed and fixed by the spring plate 58 through the medium of the ring plate 59, and the plunger 61 is forced into the mold 40 to mold the glass gob.

After the press molding, the molded product is cooled in the positions P3 to P7. In the middle position P5 for this process, the shell ring 63 of the mold 40 is removed from the bottom 62 and moved to the position P9. Then, in the position P8, the molded product is taken out of the pressing machine 51 through the bottom 62. Further, the bottom 62 is cooled in the position P9.

As seen from FIGS. 15A and 15B, upper an lower parts of the outside of the molded product above and below line PL and the inside of the product are integrally molded by means of the shell ring 63, bottom 62, and plunger 61, respectively. As the boundary PL between the bottom 62 and the shell ring 63 is situated near the top surface of the inner wall 28, in particular, the shell ring 63 can mold the greater parts of the inner and side walls 28 and 26 and the top surface portion of the inner wall 28.

FIGS. 15A and 15B show the way of molding the miniature envelope element 22*a*′. It is to be understood, however, that the other miniature envelope elements 22*b*′ to 22*e*′ can be formed by the same method using similar mold configurations, and a description of the way of molding those elements is omitted.

The miniature envelope elements 22*a*′ to 22*e*′ press-molded in the aforementioned processes are set in a slow-cooling oven (not shown) so as to eliminate strain, for example. Alternatively, each of the miniature envelope elements 22*a*′ to 22*e*′ may be thrown into the slow-cooling oven after a residual glass pool 38 formed on the lower end portion of the funnel 4 is fused or strain-cut, as mentioned later. Further, the residual pool 38 may be cut by means of a cutter in a subsequent process, which will be mentioned later.

Figure 17:
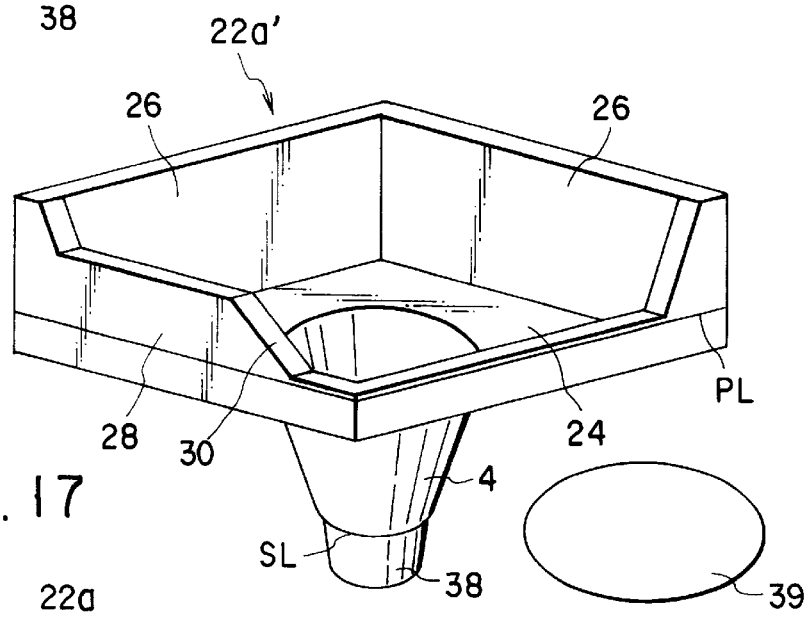
FIG. 17 is a perspective view showing a cutter along with the miniature envelope element molded by means of the pressing machine.

In each of the miniature envelope elements 22*a*′ to 22*e*′ press-molded in this manner, as shown in FIGS. 9A to 12 and 16, the residual glass pool 38 exists on the end portion of the funnel 4. As shown in FIG. 17, the residual pool 38 is cut along a sealing line SL by means of a cutter 39. Thereafter, the miniature envelopes 22*a* to 22*e* shown in FIGS. 5A to 7 are formed by polishing the miniature envelope elements to remove unnecessary portions.

Figure 18:
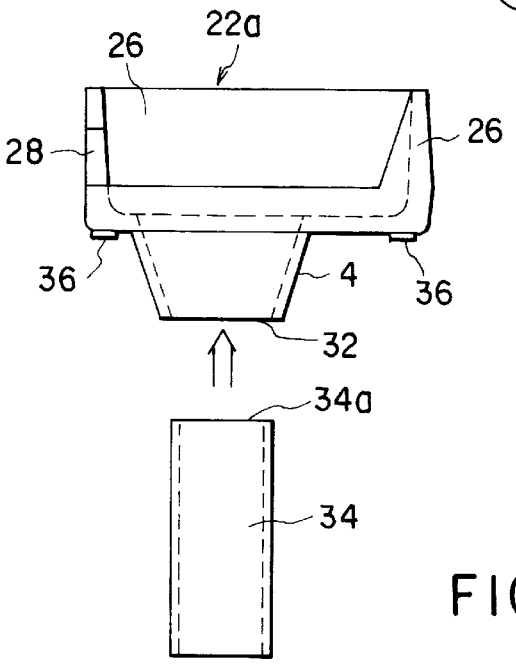
FIG. 18 is a side view showing a polished miniature envelope and a neck tube.
Figure 19:
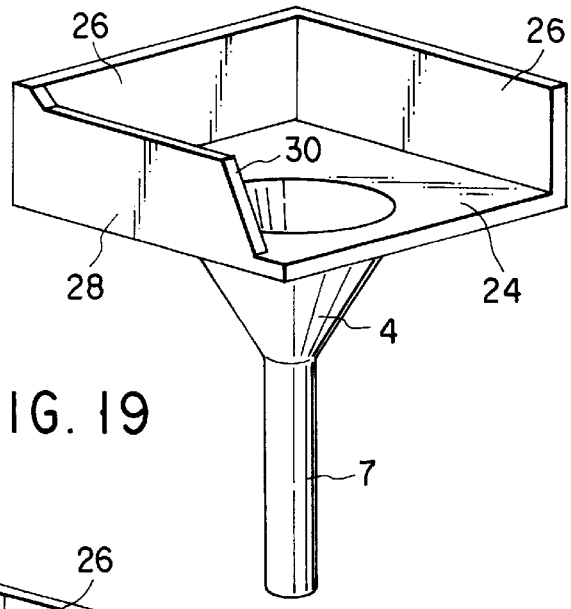
FIG. 19 is a perspective view showing the miniature envelope having the neck tube bonded thereto.
Figure 20:
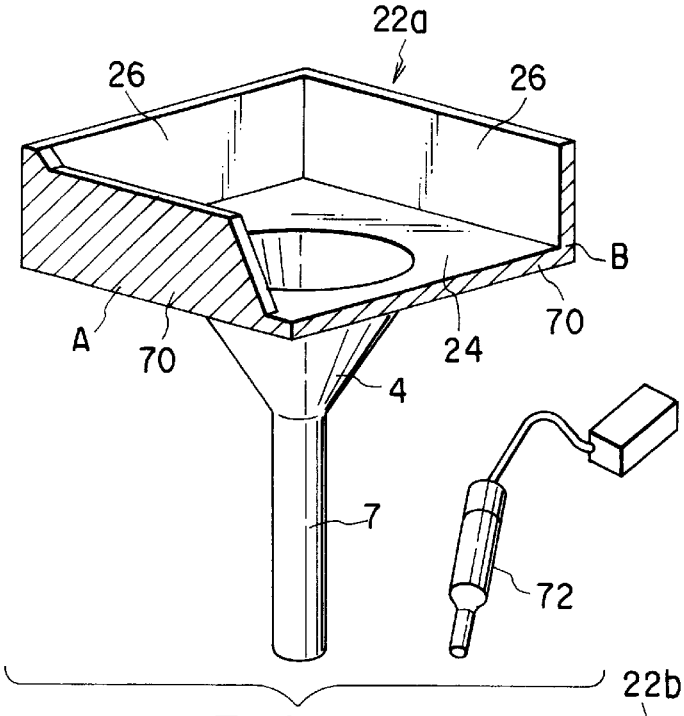
FIG. 20 is a perspective view showing the miniature envelope coated with solder glass on its joint surfaces and an applicator.
Figure 21:
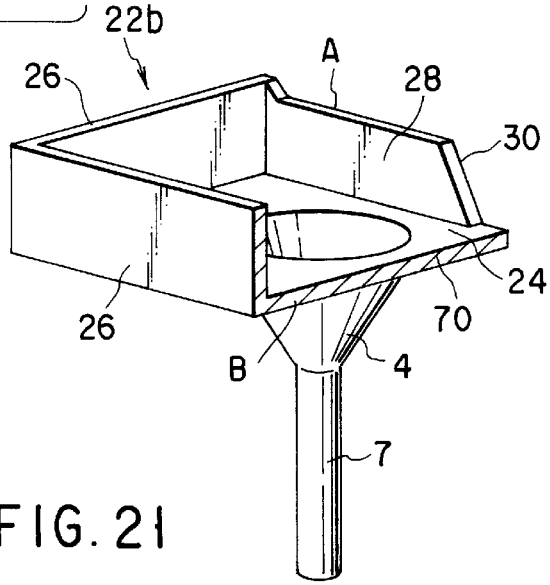
FIG. 21 is a perspective view showing another miniature envelope coated with the solder glass on its joint surfaces.
Figure 22A:
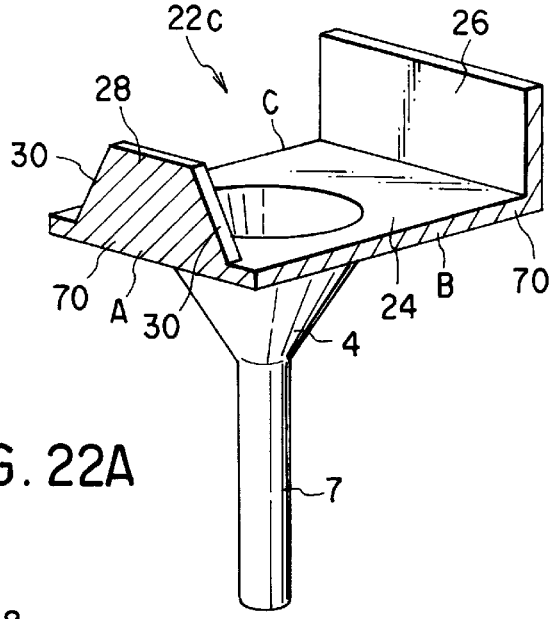
FIGS. 22A, 22B and 22C are perspective views individually showing miniature envelopes of three types coated with the solder glass on their joint surfaces.
Figure 22B:
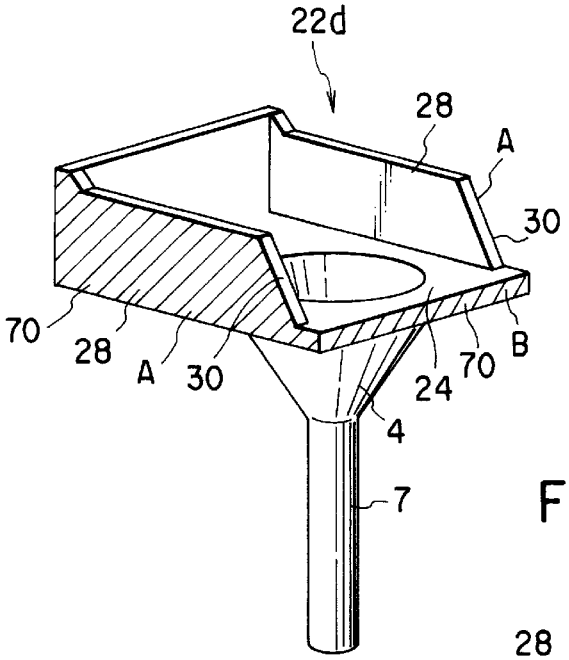
Figure 22C:
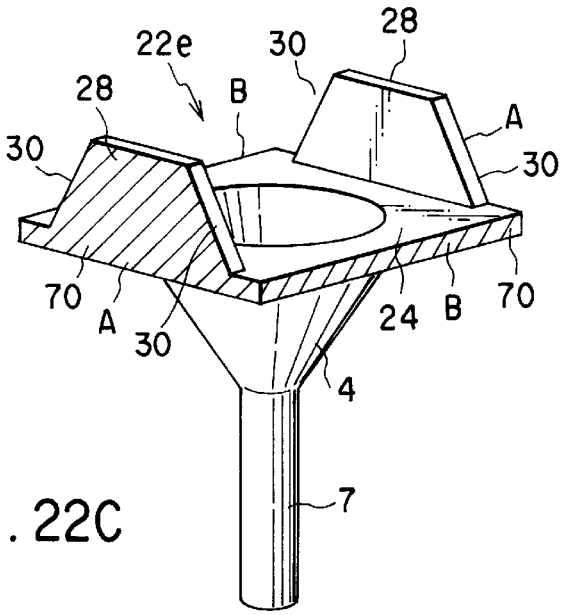

Then, those surfaces of the individual miniature envelopes which are connected in a matrix in a subsequent process, that is, the side faces of the bottom wall 24 and the outer surfaces of the inner walls 28, are polished into flat surfaces. Thereafter, one end 34*a* of the neck tube 34 is connected to the lower end of the funnel 4 of each miniature envelope by welding based on burner heating, as shown in FIG. 18. Thereupon, a miniature envelope is completed having the shape shown in FIG. 19.

In connecting the miniature envelopes 22*a* to 22*e* constructed in this manner, viscous solder glass 70 is applied to their respective polished surfaces that are in contact with the surfaces of the adjacent miniature envelopes by means of an applicator 72, for example.

FIGS. 20 to 22C show positions for the application of the solder glass 70 to the miniature envelopes 22*a* to 22*e*. In each of the miniature envelopes 22*a* and 22*b*, the solder glass 70 is applied to two surfaces, the outer surface (surface A) of the inner wall 28 and the combination (surface B) of the end face of one of the side walls 26 and a side face of the bottom wall 24. In each miniature envelope 22*c*, the solder glass 70 is applied to three surfaces, the outer surface (surface A) of the inner wall 28 and the combinations (surfaces B and C) of the respective opposite end faces of the bottom wall 24 and the side wall 26. In each miniature envelope 22*d*, the solder glass 70 is applied to two surfaces, the respective outer surfaces (surface A) of the two inner walls 28 and a side face (surface B) of the bottom wall 24. In each miniature envelope 22*e*, moreover, the solder glass 70 is applied to the respective outer surfaces (surface A) of the two inner walls 28 and all the four side faces (surface B) of the bottom wall 24.

The solder glass 70 for the connection of the miniature envelopes 22*a* to 22*e* may be applied to only one of each two opposite joint surfaces instead of being applied to both.

Figure 23:
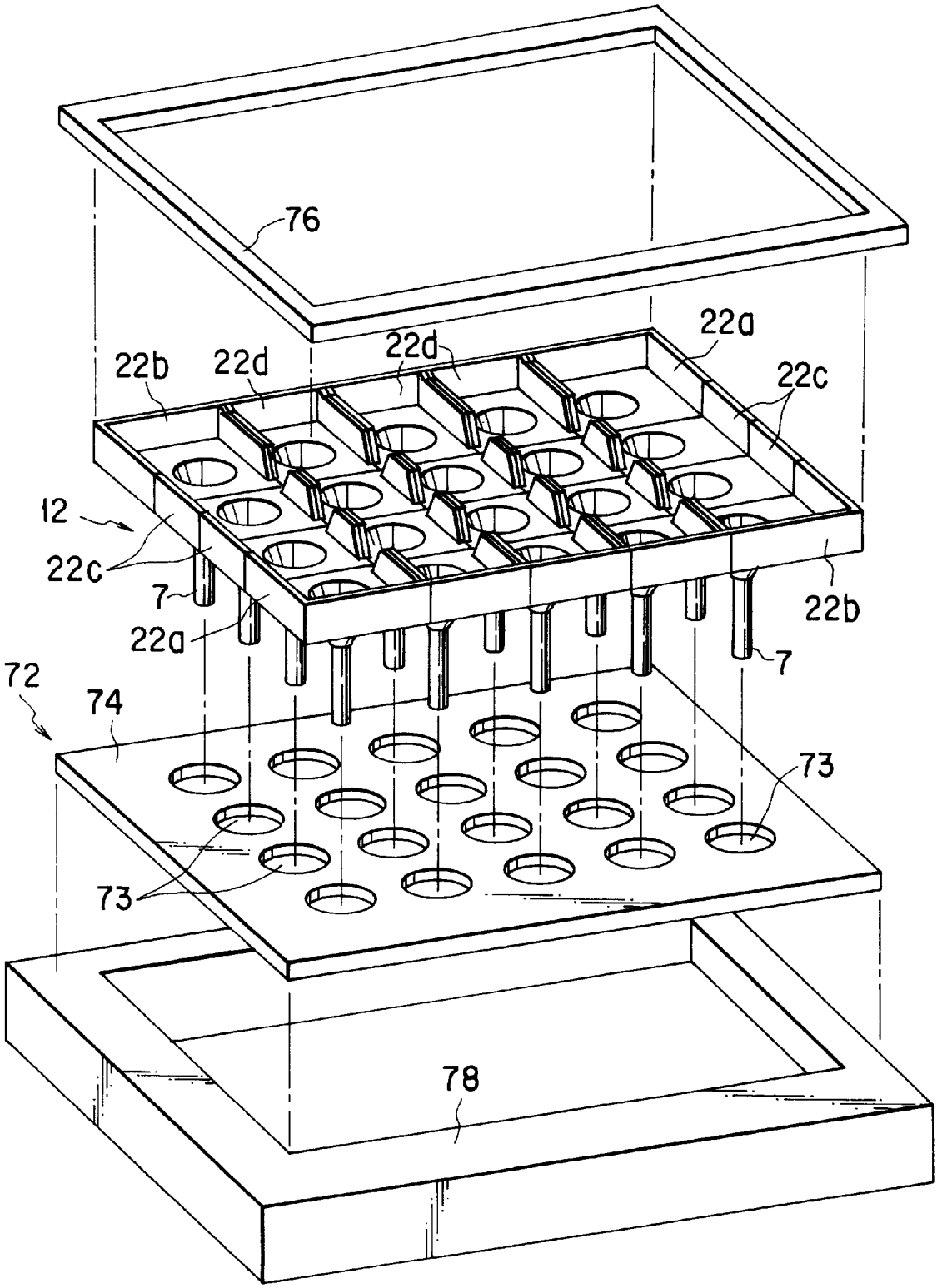
FIG. 23 is an exploded perspective view showing the miniature envelopes bonded to one another and an assembly jig.
Figure 24:
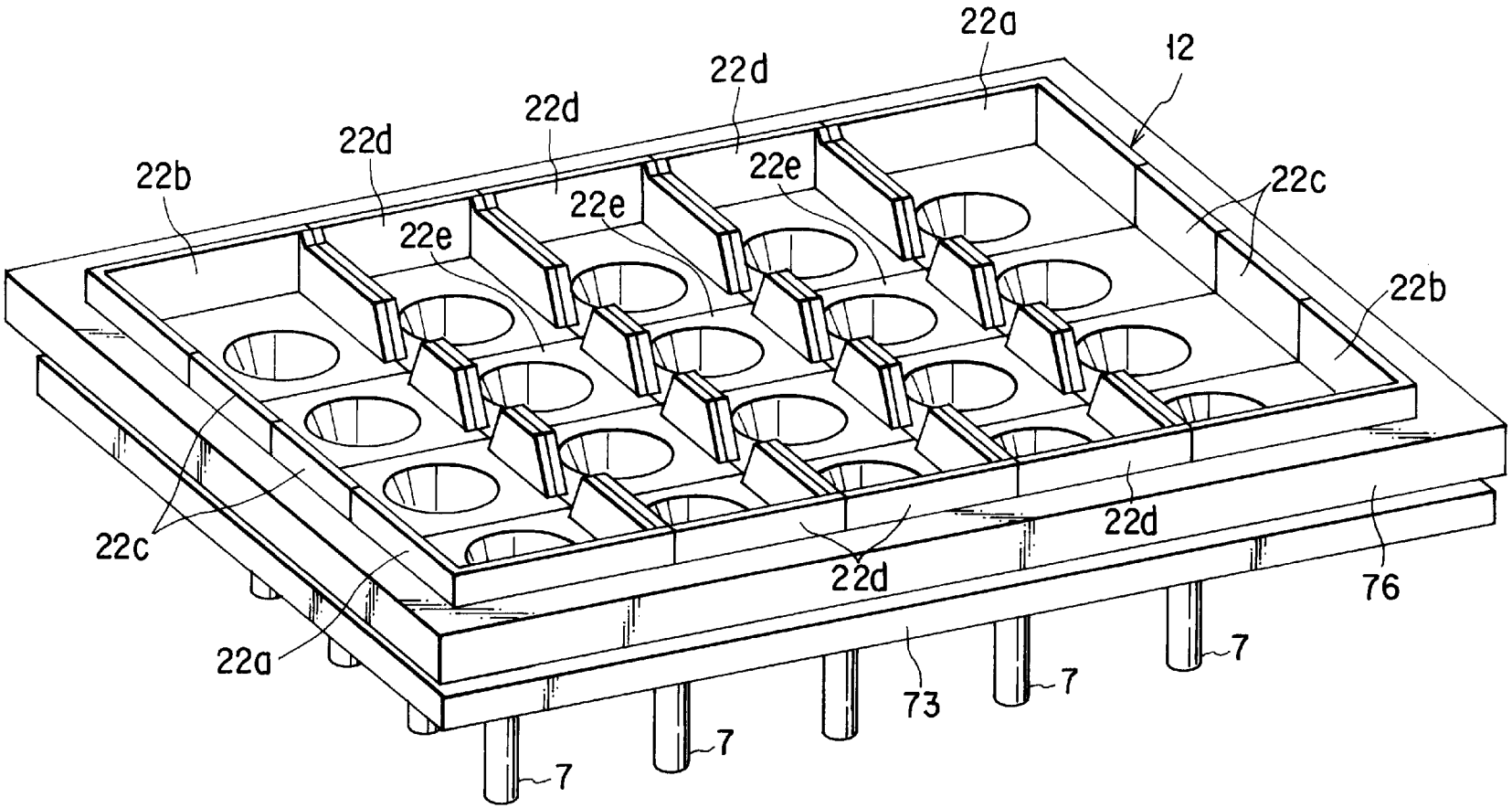
FIG. 24 is a perspective view showing the bonded miniature envelopes and the assembly jig.
Figure 25:
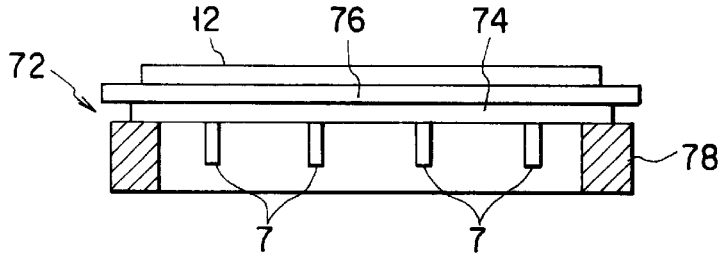
FIG. 25 is a side view showing the bonded miniature envelopes and the assembly jig.

Then, the miniature envelopes 22*a* to 22*e*, coated with the solder glass 70, are connected by means of an assembly jig 72. As shown in FIGS. 23, 24 and 25, the jig 72 is provided with a support plate 74, retaining frame 76, and rectangular base frame 78. The support plate 74 is formed having a number of apertures 73 arranged in a matrix corresponding to the funnels 4. The respective necks 7 and funnels 4 of the miniature envelopes 22*a* to 22*e* are inserted into their corresponding apertures 73, and are supported in a given array. Subsequently, the retaining frame 76 is fitted on the combined miniature envelopes, whereby the miniature envelopes are located in position. Then, the resulting structure is placed on the base frame 78.

Figure 26:
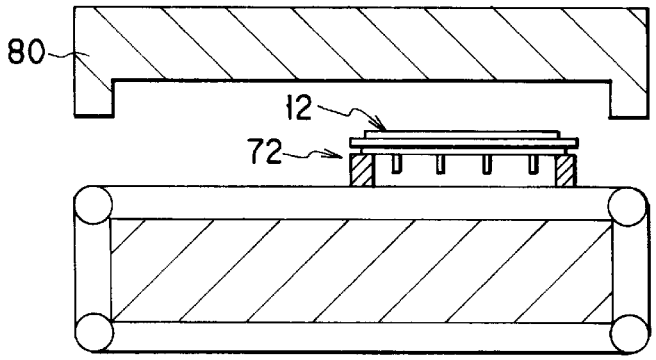
FIG. 26 is a sectional view schematically showing a heating oven for heating the bonded miniature envelopes.

As shown in FIG. 26, thereafter, the assembly is heated to the sealing temperature of the solder glass in a heating oven 80, whereby the solder glass is welded. By doing this, the miniature envelopes 22*a* to 22*e* are connected to one another to form the rear envelope 12 of the cathode ray tube.

According to the color cathode ray tube constructed in this manner, the miniature envelopes 22*a* to 22*e* that constitute the rear envelope 12 are molded by directly utilizing the pressing technique that is used in molding bulbs for existing cathode ray tubes. Accordingly, the molding operation is easy, and existing manufacturing equipment can be diverted to the purpose. Thus, there is no need of investment on new equipment that entails an increase in manufacturing cost.

The rear envelope 12 is formed by bonding a plurality of miniature envelopes together. If there is any failure in neck welding or the like, therefore, it is necessary only that a single miniature envelope or envelopes be replaced. Accordingly, the manufacturing efficiency and hence economical efficiency can be improved. In the case where the pressing technique is used for the molding operation, moreover, the cost at which the miniature envelopes are press-molded from a novel material can be made much lower than the cost at which a glass sheet is molded from the novel material. Thus, the miniature envelopes can be molded with use of a material for bulbs for existing cathode ray tubes.

Since the rear envelope is constructed by connecting the miniature envelopes 22*a* to 22*e*, various cathode ray tubes with different sizes can be manufactured by changing the number and combination of miniature envelopes. Thus, larger screens can be easily formed without requiring new molds. At the same time, the manufacturing cost can be lowered.

According to the present embodiment, therefore, there may be provided a cathode ray tube and a manufacturing method therefor, whereby the reliability of the withstand voltage characteristics, vacuum characteristics, etc. of a vacuum envelope can be satisfactorily maintained, other characteristics of the envelope, such as volume resistivity, coloring by electron rays, X-ray leakage, etc., can be fulfilled, and molding can be easily carried out without increasing the manufacturing cost.

The shapes of the miniature envelopes that constitute the rear envelope 12 are not limited to the ones described in connection with the foregoing embodiment, and may be changed or modified without departing from the scope of the invention.

Figure 27:
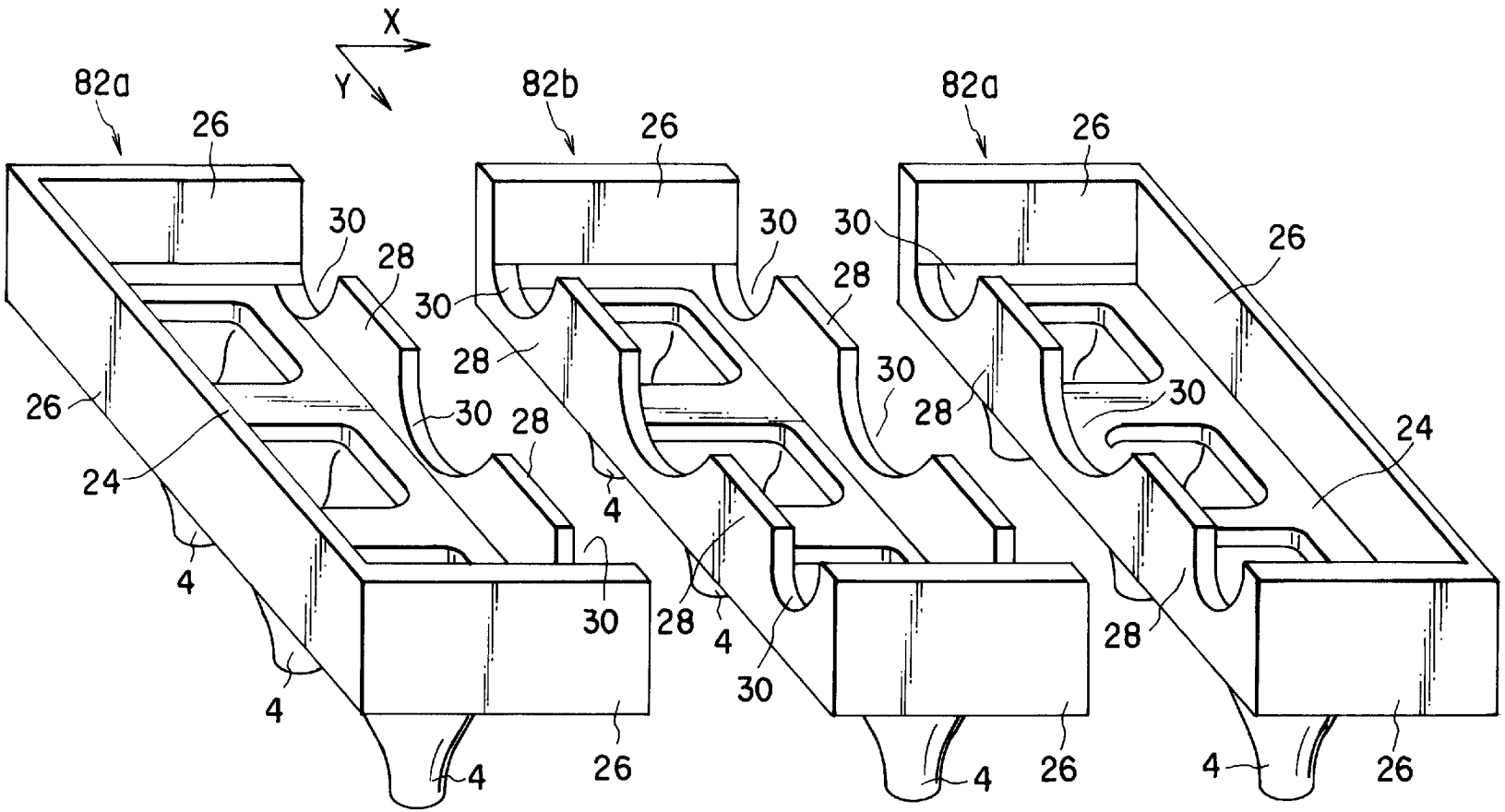
FIG. 27 is an exploded perspective view showing miniature envelopes constituting a rear envelope of a cathode ray tube according to a second embodiment of the invention.

FIG. 27 shows miniature envelopes 82*a* and 82*b* that constitute a rear envelope 12 of a cathode ray tube according to a second embodiment of the invention. In the present embodiment, the rear envelope 12 is formed by connecting the miniature envelopes 82*a* and 82*b* of two different types.

Each miniature envelope 82*a* (first miniature envelope), which constitutes an end portion of the rear envelope 12 in the horizontal direction X, includes a rectangular bottom wall 24, side walls 26, and an inner wall 28. The bottom wall 24, which has three funnels 4, is elongated in the vertical direction Y. The side walls 26 are set up individually on one long side and a pair of short sides of the bottom wall, while the inner wall 28 is set up on the other long side of the bottom wall. The height of the inner wall 28 is adjusted to 70 to 95% of that of each side wall 26. The inner wall 28 is formed having three semicircular notches 30 that are spaced in the vertical direction Y.

Each miniature envelope 82*b* (second miniature envelope), which constitutes the central portion of the rear envelope 12 in the horizontal direction, includes a rectangular bottom wall 24, side walls 26, and inner walls 28. The bottom wall 24, which has three funnels 4, is elongated in the vertical direction Y. The side walls 26 are set up individually on a pair of short sides of the bottom wall, while the inner walls 28 are set up individually on a pair of long sides of the bottom wall. The height of each inner wall 28 is adjusted to 70 to 95% of that of each side wall 26. Each inner wall 28 is formed having three semicircular notches 30 that are spaced in the vertical direction Y.

The miniature envelopes 82*a* are located individually on the horizontally opposite ends, one or more miniature envelopes 82*b* are interposed between the envelopes 82*a*, and these miniature envelopes are connected to one another, whereupon the rear envelope 12 having a desired size is completed. Other components are constructed in the same manner and molded by the same method as in the foregoing embodiment, and a detailed description of those components is omitted.

Figure 28A:
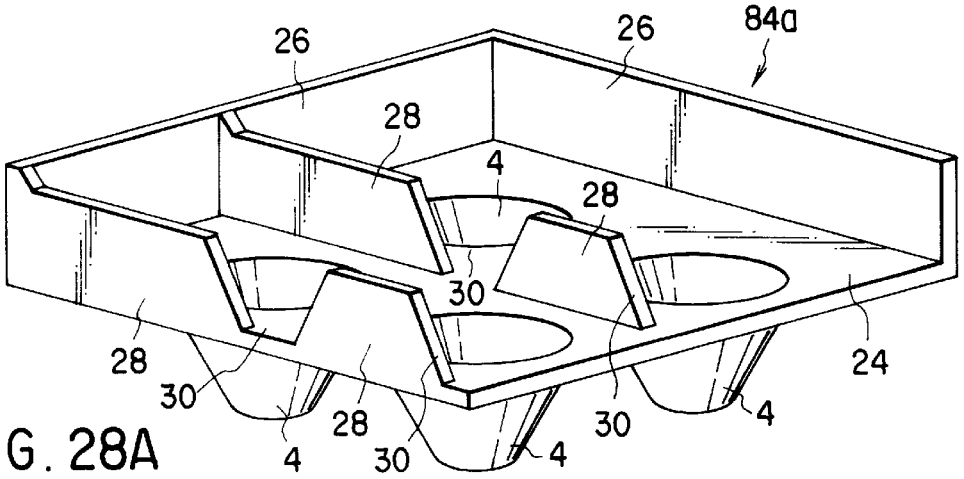
FIGS. 28A and 28B are perspective views individually showing miniature envelopes constituting a rear envelope of a cathode ray tube according to a third embodiment of the invention.
Figure 28B:
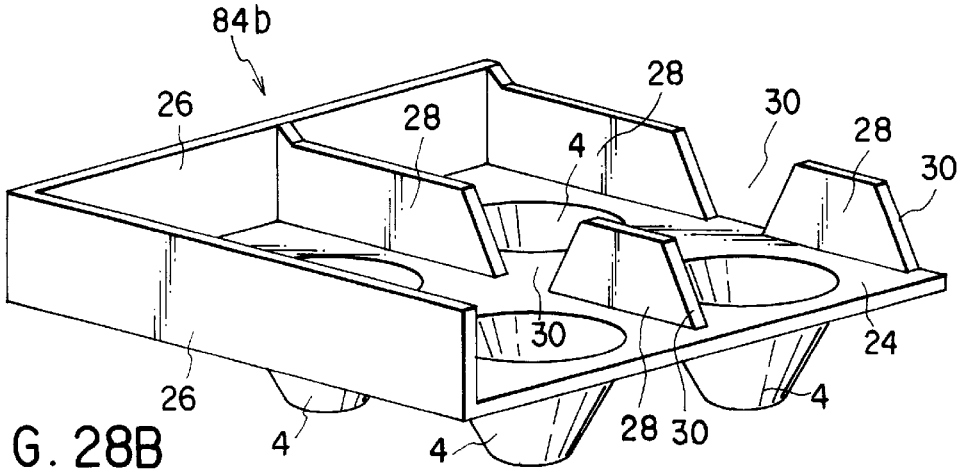

FIGS. 28A and 28B individually show miniature envelopes that constitute a rear envelope 12 of a cathode ray tube according to a third embodiment of the invention. According to the present embodiment, the rear envelope 12 is formed by connecting miniature envelopes 84*a* and 84*b* of two different types in two pairs. Each of the miniature envelopes 84*a* and 84*b* includes four funnels 4 that are arranged in a matrix. The corner portions of the rear envelope 12 are formed by using two pairs of these different miniature envelopes. By connecting these miniature envelopes, the rear envelope is formed having 16 funnels.

Each miniature envelope 84*a* (first miniature envelope) includes a rectangular bottom wall 24 having four funnels 4 arranged in a matrix, side walls 26 set up individually on two orthogonal sides of the bottom wall, and a pair of inner walls 28 set up parallel to one of the side walls 26 on another side of the bottom wall and corresponding to the center of the other side wall 26, individually. The height of each inner wall 28 is adjusted to 70 to 95% of that of each side wall 26. Each inner wall 28 is formed having a plurality of notches 30. Each miniature envelope 84*b*(second miniature envelope) is constructed including the same components of each miniature envelope 84*a*. The envelope 84*b* differs from the envelope 84*a* only in that the side walls 26 and the inner walls 28 are directed differently.

Other components are constructed in the same manner and molded by the same method as in the foregoing embodiments, and a detailed description of those components is omitted.

Figure 29A:
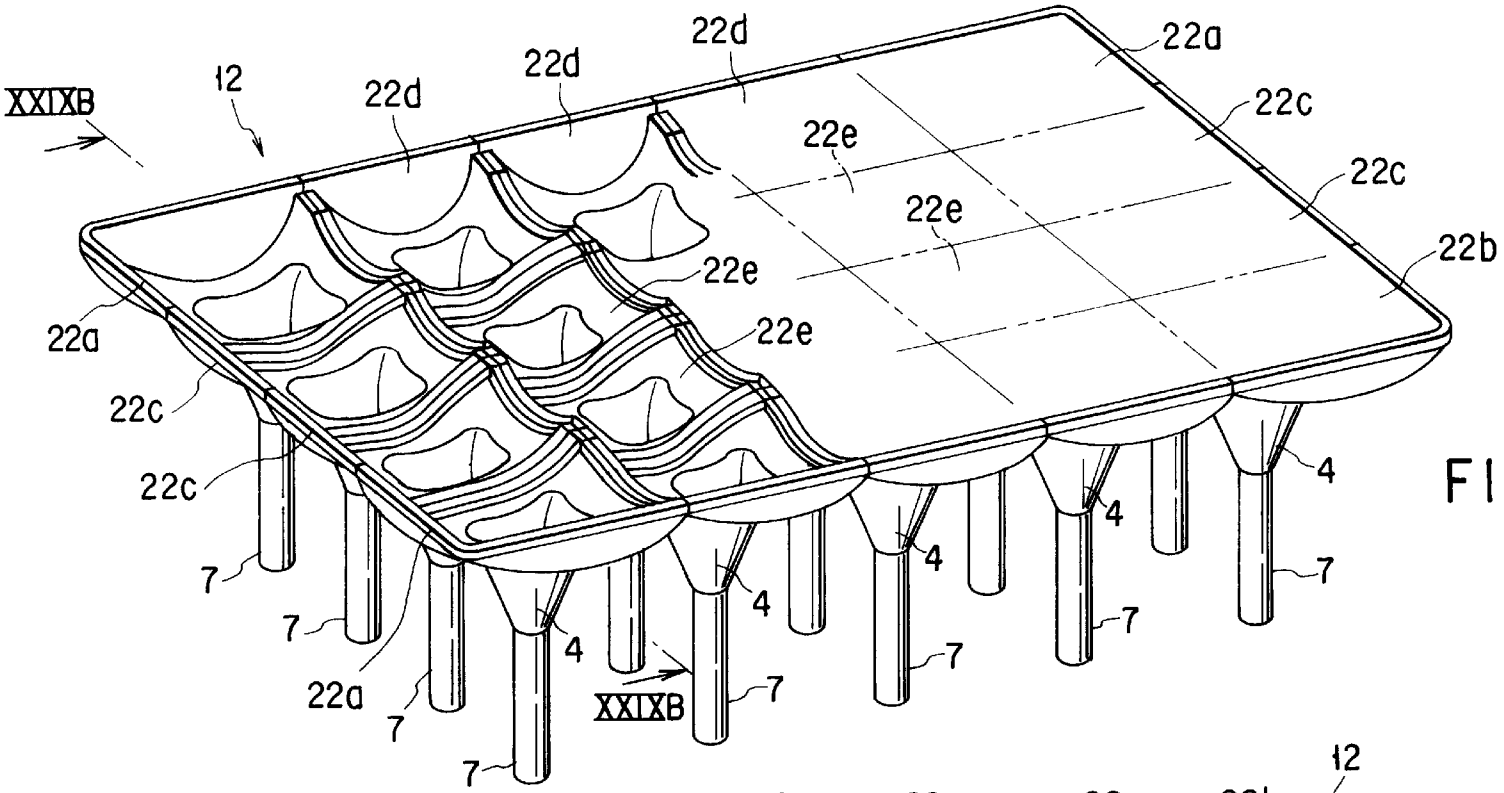
FIG. 29A is a perspective view showing a rear envelope of a cathode ray tube according to a fourth embodiment of the invention.
Figure 29B:
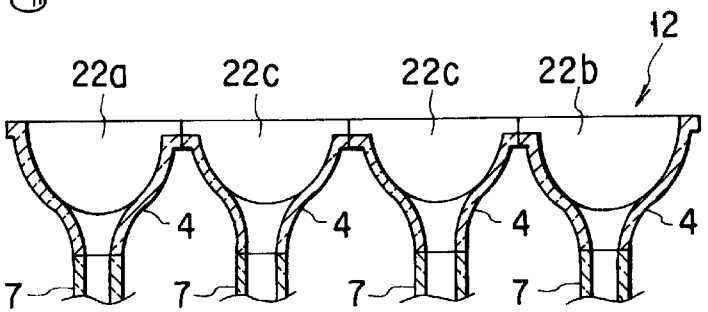
FIG. 29B is a sectional view taken along line XXIX—XXIX of FIG. 29A.

In a fourth embodiment of the invention shown in FIGS. 29A and 29B, a plurality of miniature envelopes 22*a* to 22*e* that constitute a rear envelope 12 of a cathode ray tube are formed by integrally curving side walls, inner walls, and bottom walls. This arrangement is particularly effective for the case where the rear envelope 12 is formed by thermally welding the miniature envelopes 22*a* to 22*e* by burner heating or the like.

The present invention is not limited to the first to fourth embodiments described above, and the miniature envelopes may be variously modified in shape and freely combined without departing from the scope of the invention. Further, the respective sizes and shapes of the side walls, inner walls, and funnels that constitute the miniature envelopes are not limited to the ones described in connection with the foregoing embodiments, and may be suitably determined depending on the size and shape of the cathode ray tube.

According to the embodiments described above, furthermore, the cathode ray tube comprises the substantially rectangular flat faceplate 1 of glass, the substantially rectangular rear envelope 12 of glass having the funnels 4, and the support members 16 supporting the atmospheric pressure that acts on the faceplate and the rear envelope. However, the present invention is not limited to those embodiments, and may be also applied to a cathode ray tube that comprises a substantially rectangular face panel, a rear envelope opposed to the face panel, and necks connected to the rear envelope.

Figure 30C:
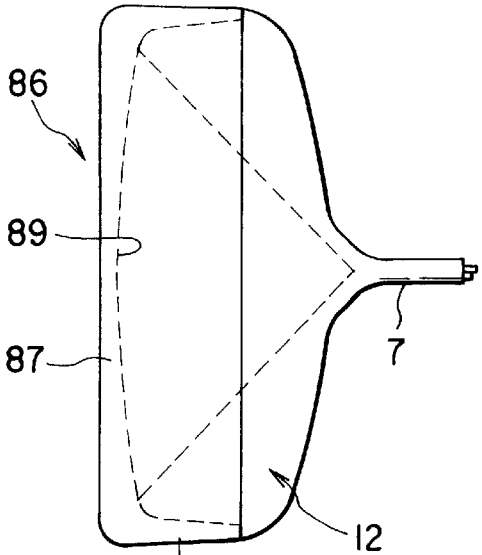
FIGS. 30A, 30B and 30C are a plan view, front view, and side view, respectively, of a cathode ray tube according to a fifth embodiment of the invention.
Figure 30A:
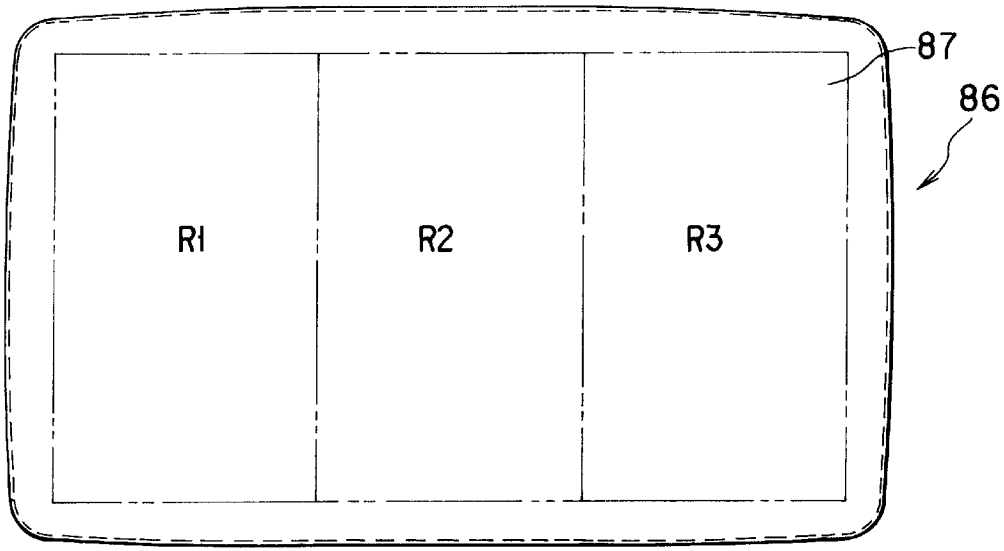
Figure 30B:
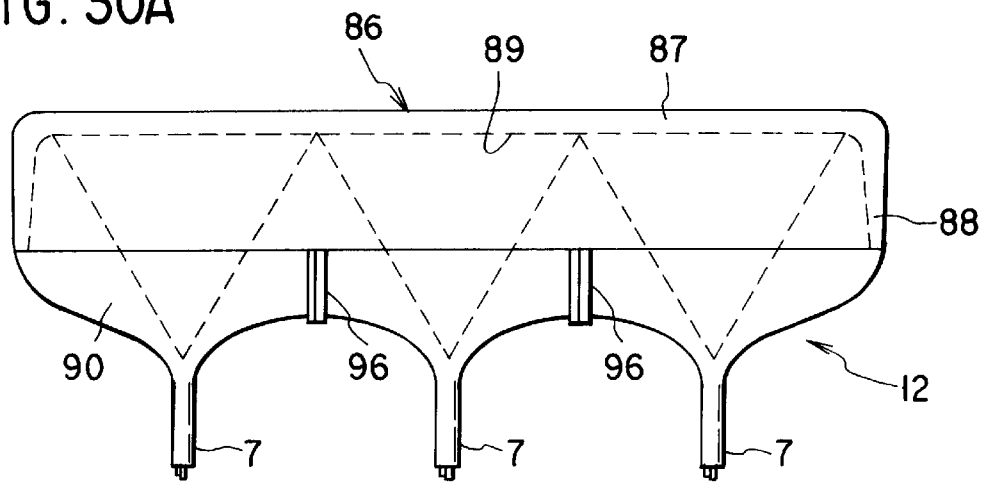
Figure 32F:
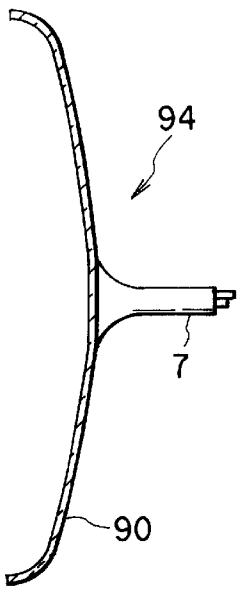
FIGS. 32A to 32F are plan views, front views, and side views individually showing miniature envelopes of two types constituting the rear envelope of the cathode ray tube according to the fifth embodiment.
Figure 32D:
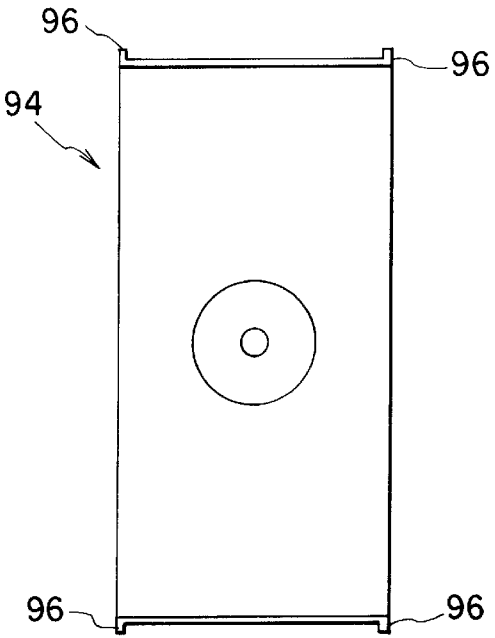
Figure 32E:
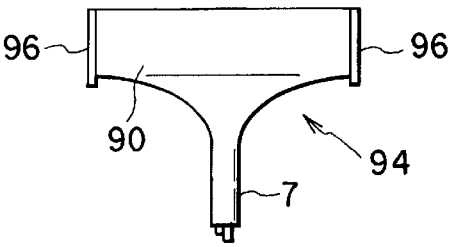
Figure 32C:
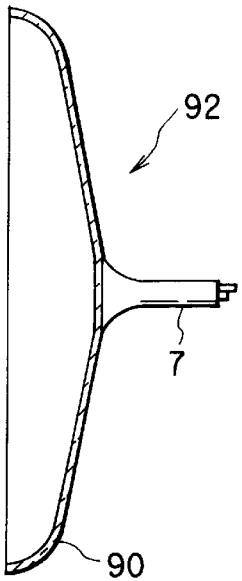
Figure 32A:
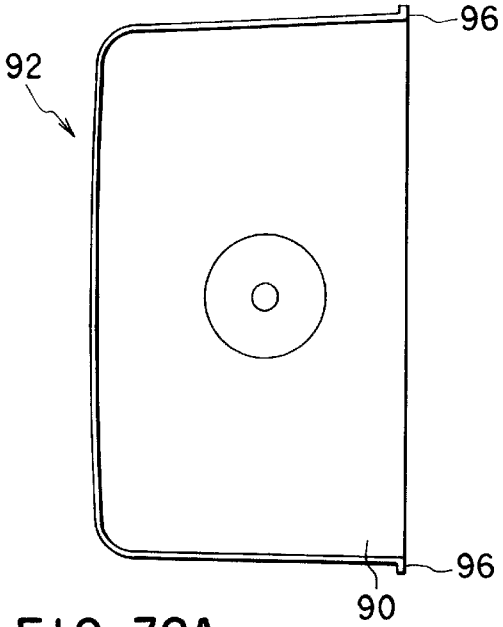
Figure 32B:
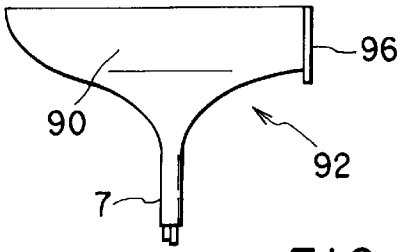

As shown in FIGS. 30A, 30B and 30C, a vacuum envelope 10 of a cathode ray tube according to a fifth embodiment of the invention comprises a face panel 86, a rear envelope 12 opposed to the panel, and necks 7 connected to the rear envelope. The face panel 86 includes a substantially rectangular faceplate section 87 and a skirt section 88 around it. The rear envelope 12, which is bonded to the skirt section 88, include a plurality of funnels 90, e.g., three in number. The necks 7 are bonded to the funnels 90, individually.

An electron gun (not shown) is located in each neck 7, and a deflector (not shown) is provided around the funnel section. As electron beams emitted from the electron guns are deflected in the horizontal and vertical directions by means of the deflector, three regions R1, R2 and R3 of a phosphor screen 89, which is formed on the inner surface of the faceplate section 87, are scanned separately.

As shown in FIGS. 30A to 32F, the rear envelope 12 is formed by connecting two miniature envelopes 92, which constitute the opposite end portions of the rear envelope, and a miniature envelope 94, which constitutes the central portion of the rear envelope. These miniature envelopes 92 and 94, like the ones according to the foregoing embodiments, are manufactured by pressing a glass gob, then cutting a residual pool, and welding a neck tube to the resulting structure.

A funnel section 90 of each miniature envelope 92 is in the form of a slender rectangular funnel. One side portion of the funnel section 90 in the longitudinal direction thereof is cut off to form an opening, and a connecting flange 96 protrudes from the peripheral edge of the opening. A funnel section 90 of the miniature envelope 94 is in the form of a slender rectangular funnel. Both side portions of the funnel section 90 in the longitudinal direction thereof are cut off to form openings, and a connecting flange 96 protrudes from the peripheral edge of each opening.

Solder glass is applied to the respective flanges 96 of the miniature envelopes 92 and 94, and the miniature envelope 94 is held between the paired miniature envelopes 92 by means of a fixing jig (not shown). Thereafter, the respective flanges 96 of the miniature envelopes are heated to be welded together in a heating oven. Then, the rear envelope 12, which is formed by connecting the miniature envelopes 92 and 94, and the skirt section 88 of the face panel 86 are bonded together by means of the solder glass, whereupon the vacuum envelope 10 is completed.

Arranged in this manner, the fifth embodiment can produce the same functions and effects of the foregoing embodiments.

Although the miniature envelopes 92 and 94 are bonded with the solder glass according to the fifth embodiment, they may alternatively be connected by welding based on burner heating or some other method. Further, the number of necks attached to the rear envelope 12 is not limited to three, and may alternatively be two or four or more.

According to the first to fifth embodiments described herein, the cathode ray tubes are of a type such that a shadow mask is used for color selection. However, the present invention is not limited to those embodiments, and may be also applied to, for example, monochrome cathode ray tubes, index-type cathode ray tubes, etc.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube comprising:

a substantially rectangular faceplate;

a substantially rectangular rear envelope fixed directly to the faceplate, the rear envelope including a plurality of funnels opposed to the faceplate;

a plurality of necks connected to the funnels, individually; and a plurality of support members arranged between the faceplate and the rear envelope and supporting the atmospheric pressure acting on the faceplate and the rear envelope, the rear envelope being formed by connecting a plurality of miniature envelopes, each of the miniature envelopes being integrally molded and including a funnel corresponding to at least one of the necks.

2. A cathode ray tube according to claim 1, wherein the rear envelope includes a substantially rectangular rear plate opposed to the faceplate and provided with the funnels, a substantially rectangular side wall set up on a peripheral edge of the rear plate, and a plurality of partition walls extending from the rear plate toward the faceplate, each of the partition walls being lower than the side wall, the support members being located on the partition walls, individually.

3. A cathode ray tube according to claim 2, wherein the miniature envelopes include first and second miniature envelopes individually constituting the corner portions of the rear envelope, third and fourth miniature envelopes individually constituting the side edge portions of the rear envelope, and fifth miniature envelopes constituting the central portion of the rear envelope, the first and second miniature envelopes each including a rectangular bottom wall forming the rear plate, side walls set up individually on two adjacent sides of the bottom wall and forming the side wall of the rear envelope, an inner wall set up on the bottom wall and forming one of the partition walls, and at least one funnel extending from the bottom wall, each of the third miniature envelopes including a rectangular bottom wall forming the rear plate, a side wall set up on one side of the bottom wall and forming the side wall of the rear envelope, an inner wall set up on another side of the bottom wall opposite to the one side and forming one of the partition walls, and at least one funnel extending from the bottom wall, each of the fourth miniature envelopes including a rectangular bottom wall forming the rear plate, a side wall set up on one side of the bottom wall and forming the side wall of the rear envelope, a pair of inner walls set up on two other sides of the bottom wall adjacent to the one side and forming one of the partition walls, and at least one funnel extending from the bottom wall, and each of the fifth miniature envelopes including a rectangular bottom wall forming the rear plate, a pair of inner walls set up on two opposite sides of the bottom wall and individually forming two of the partition walls, and at least one funnel extending from the bottom wall.

4. A cathode ray tube according to claim 2, wherein the rear envelope includes two pairs of first and second miniature envelopes which are connected to each other and constitute the corner portions of the rear envelope, the first and second miniature envelopes each including a rectangular bottom wall forming the rear plate, a plurality of funnels extending from the bottom wall, side walls set up individually on two adjacent sides of the bottom wall and forming the side wall of the rear envelope, and a plurality of inner walls set up parallel to one of the side walls on the bottom wall, situated between the funnels, and individually forming the partition walls.

5. A cathode ray tube according to claim 2, wherein the rear envelope includes a pair of first miniature envelopes individually constituting the opposite end portions of the rear envelope, and at least one second miniature envelope located between the first miniature envelopes, the first and second miniature envelops being connected to each other, each of the first miniature envelopes including a rectangular bottom wall forming the rear plate, a plurality of funnels extending from the bottom wall, side walls set up individually on three sides of the bottom wall and forming the side wall of the rear envelope, and an inner wall set up on the other side of the bottom wall and forming the partition walls, the second miniature envelope including a rectangular bottom wall forming the rear plate, a plurality of funnels extending from the bottom wall, a pair of side walls set up individually on two opposite sides of the bottom wall and forming the side wall of the rear envelope, and a pair of inner walls set up individually on two other sides of the bottom wall and individually forming the partition walls, each of the inner walls having a notch.

6. A cathode ray tube according to claim 2, wherein each of the miniature envelopes includes a bottom wall constituting a part of the rear plate, a funnel extending from the bottom wall, at least one side wall constituting a part of the side wall of the rear envelope, and an inner wall constituting a part of the partition walls, inner walls having a notch.

7. A cathode ray tube comprising:

a substantially rectangular faceplate having a phosphor screen formed on an inner surface thereof;

a substantially rectangular rear envelope fixed directly to the faceplate, the rear envelope including a plurality of funnels opposed to the faceplate;

a plurality of necks connected to the funnels, individually; and a plurality of support members arranged between the faceplate and the rear envelope and supporting the atmospheric pressure acting on the faceplate and the rear envelope; and a plurality of electron guns located individually in the necks, for dividedly scanning a plurality of regions of the phosphor screen with electron beams, the rear envelope being formed by connecting a plurality of miniature envelopes, each of the miniature envelopes including a funnel corresponding to at least one of the necks and being integrally molded.

8. A cathode ray tube comprising:

a substantially rectangular face panel including a substantially rectangular faceplate having a phosphor screen formed on an inner surface thereof and a skirt section set up on the peripheral edge of the faceplate section, the face plate section and the skirt section being integrally molded;

a rear envelope directly fixed to the skirt section of the face panel; and a plurality of necks connected to the rear envelope, the rear envelope being formed by connecting a plurality of miniature envelopes, each of the miniature envelopes including a funnel directly bonded to the skirt section.

* * * * *